US006988731B2

(12) United States Patent
Inoue

(10) Patent No.: US 6,988,731 B2
(45) Date of Patent: Jan. 24, 2006

(54) SYMBOL DISPLAY DEVICE FOR GAME MACHINE

(75) Inventor: Haruo Inoue, Tokyo (JP)

(73) Assignee: Dragon Co., Ltd., Tokyo (JP)

( * ) Notice: Subject to any disclaimer, the term of this patent is extended or adjusted under 35 U.S.C. 154(b) by 363 days.

(21) Appl. No.: 10/449,092

(22) Filed: Jun. 2, 2003

(65) Prior Publication Data

US 2004/0183251 A1 Sep. 23, 2004

(30) Foreign Application Priority Data

Mar. 19, 2003 (JP) ..... 2003-075942

(51) Int. Cl.
*G07F 17/34* (2006.01)
*A63F 9/00* (2006.01)

(52) U.S. Cl. ..... 273/142 H; 273/142 HA; 273/143 R; 273/138.2; 463/20; 463/31

(58) Field of Classification Search ..... 273/142 H, 273/142 HA, 143 R, 138.2, 138.1; 463/20, 463/31

See application file for complete search history.

(56) References Cited

U.S. PATENT DOCUMENTS 5,096,196 A * 3/1992 Gutknecht et al. .... 273/142 HA
5,152,529 A 10/1992 Okada
5,395,111 A * 3/1995 Inoue ..... 273/143 R
6,105,962 A * 8/2000 Malavazos et al. ..... 273/143 R
6,398,220 B1 * 6/2002 Inoue ..... 273/142 R
2003/0027628 A1 * 2/2003 Luciano ..... 463/20
2004/0014517 A1 * 1/2004 Inoue ..... 463/20

FOREIGN PATENT DOCUMENTS

GB 2165074 A * 4/1986
JP 6-91034 * 4/1994
JP 6-327807 11/1994
JP 7-22301 5/1995
JP 8-17846 2/1996
JP 2000-116843 4/2000

* cited by examiner

*Primary Examiner*—Benjamin Layno

(57) ABSTRACT

Transparent blank symbols are disposed on each of first, second and third display parts respectively provided in first, second and third display plates. The player wins if the same symbols of the first to third display parts are arranged in line on any of winning lines when the first to third display plates stop rotating. When the blank symbols of the first to third display parts are arranged in line on any of winning lines, the reel mounting plate starts rotating until the sub reel reaches the position behind the blank symbols. Then, the sub reel rotates and stops to display move and stop of the symbols. The symbol on the sub reel is observable through transparent parts in the blank symbols.

14 Claims, 19 Drawing Sheets

SYMBOL DISPLAY DEVICE FOR GAME MACHINE

BACKGROUND OF THE INVENTION

1. Field of the Invention

The present invention relates to a symbol display device mounted in a game machine, such as a roulette game machine. The symbol display device displays the win or the loss of the game by rotating and stopping rotational members having predetermined symbols.

2. Description Related to the Prior Art

A symbol display device mounted in a slot game machine or a Pachinko game machine generally uses reels arranged in lines or in a matrix. Some symbol display devices use a liquid crystal display to simulate rotation of the reels. For instance, Japanese Patent Laid-Open Publication (JP-A) No. 2000-116843 describes a symbol display device that determines the win or lose in accordance with combinations of the symbols displayed on a rotary reel (first display) having a transparent window and a second display inside the first display. The second display is a liquid crystal display panel or another rotary reel having a diameter different from that of the first display. Additionally, U.S. Pat. No. 5,152,529 describes another example of the symbol display device that uses double structured reel composed of an outer reel having an opening and an inner reel disposed inside the outer reel. The game machines with the symbol display devices described above may change the symbols twice and provide a variety of symbol display patterns.

However, since the second display provided inside the first display is validated only when the transparent window or the opening stop on a predetermined winning line, which is not always happened, it is not possible to use the second display effectively. Accordingly, such symbol display devices have limitations to provide various display patterns of symbols. In order to provide various display patterns of symbols by use of the second display devices in the outer reels, all of the outer reels need to have transparent windows or the openings.

The symbol display device, described in Japanese Utility-Model Publication No. H07-22301, has three concentric rotary disks. The player wins if a predetermined combination of the symbols on the rotary disks is displayed in a radial direction. Such symbol display device may be more compact than that having mechanical reels arranged in lines or in a matrix. Such symbol display device, however, has insufficient display patterns in a game because a player can observe all the symbols. Thus, sufficient appeal to a player is not expected.

In order to solve the above problems, a symbol display device, described in JP-A H06-327807, has a first display device having a round rotator, for example, and a second display device having mechanical reels disposed inside of the round rotator. When a player plays a game machine that mounts such symbol display device, the first display device executes roulette game, and the second display device is operated if the player wins in the roulette game. If the player wins in the slot game executed by the second display device, the points gained by winning in the slot game is added to the points gained in the roulette game, so as to encourage the player's expectation to win. Although playing different games continuously may prevent a player from being dull, a game machine is not organized as the first and the second display devices are less associated with each other.

SUMMARY OF THE INVENTION

An object of the present invention is to provide a symbol display device for a game machine that provides various display patterns associated with the game result.

Another object of the present invention is to provide a symbol display device that improves the appeal effect to a player.

In order to achieve the above objects, the symbol display device of the present invention comprises plural concentric main display units having display parts, and a sub display unit for displaying symbols in motion and/or a static symbol behind at least one of the light-penetrate area. The sub display unit is mounted on a rotary member provided concentrically with the main display units. The main display units and said rotary member rotate separately.

In a preferred embodiment, the display part is composed of at least one symbol area in which a symbol is provided and at least one transparent non-symbol area. The light-penetrate area is one of the non-symbol area, a transparent area inside the symbol, or a transparent area outside the symbol in the symbol area.

The main display unit may have at least one transparent part inside or outside of the display part. When the sub display unit is stopped in an overlap area where the light-penetrate area of one of the main display units is overlapped with the transparent parts of other main display units, the sub display unit displays symbols in motion and/or a static symbol behind the overlap area.

The sub display unit may display symbols in motion and/or a static symbol, when the light-penetrate areas of the main display units are stopped and arranged in line. In that case, the drive mechanism rotates the rotary member to the position where the sub display unit is overlapped with the light-penetrate areas arranged in line.

It is possible to overlap the symbol of the sub display unit with the symbol of the main display unit so as to form a single composite symbol.

According to the present invention, since the display patterns of two different games by the main display units and the sub display unit are associated with each other, it is possible to improve the appeal effect to a player.

BRIEF DESCRIPTION OF THE DRAWINGS

One with ordinary skill in the art would easily understand the above-described objects and advantages of the present invention when the following detailed description is read with reference to the drawings attached hereto.

PREFERRED EMBODIMENTS OF THE INVENTION

Figure 1:
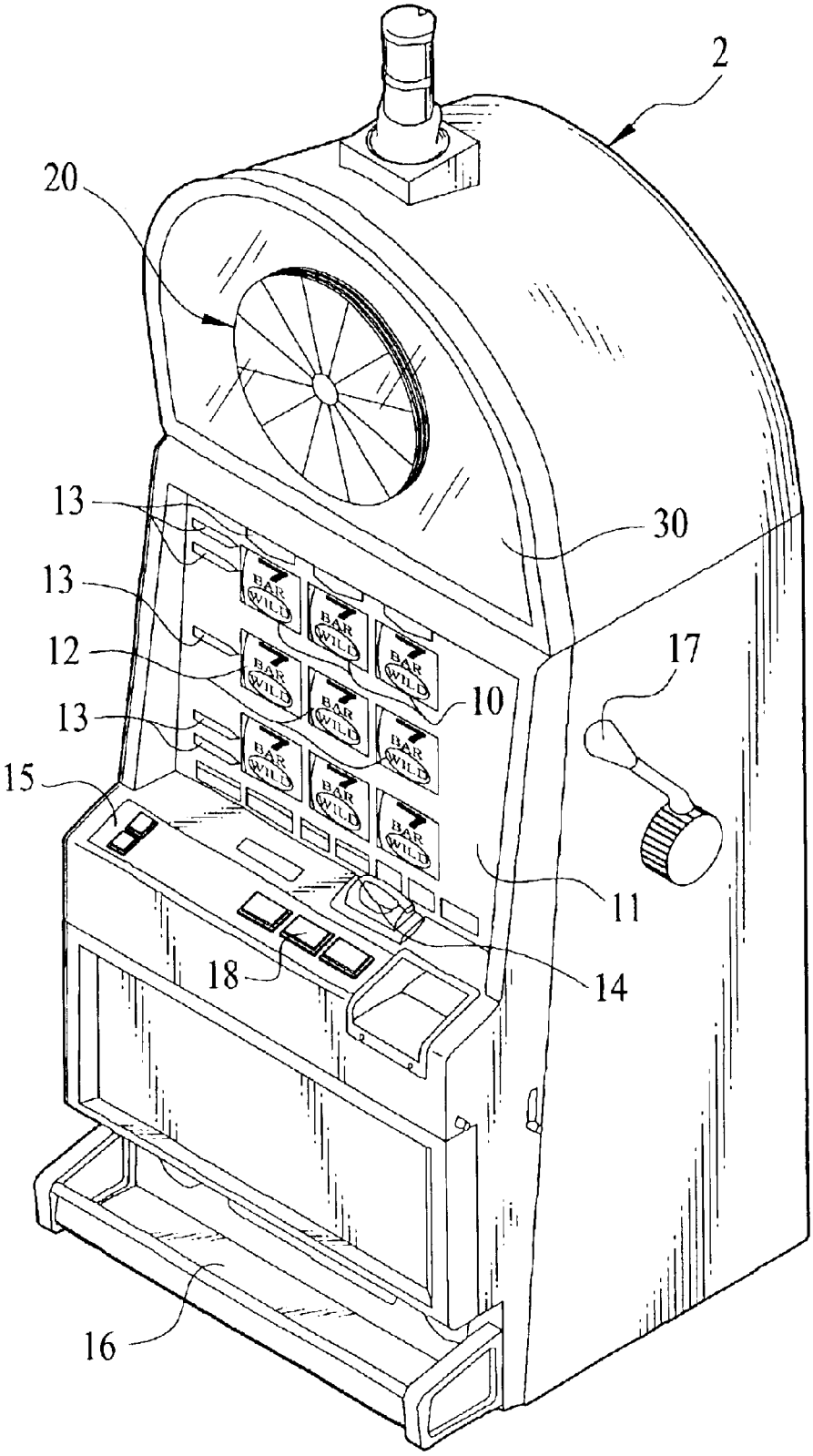
FIG. 1 is a front perspective view of a slot machine in which a symbol display device of the present invention is mounted.

As shown in FIG. 1, a slot game machine 2 has a front panel 11, wherein display windows 10 are arranged in a matrix of 3 lines and 3 rows. Reel units (not shown) are disposed behind the display windows 10 of the front panel 11, and three symbols in lengthwise direction disposed on each reel 12 may be observed through the display window 10 when reel 12 of the reel unit stops rotating. The result of the game (win or loss) is determined in accordance with symbol combinations on eight winning lines running vertically, horizontally and diagonally, or a symbol stopped in the display window 10. Indicators 13 are provided in the front panel 11 to indicate the winning lines. A coin slot 14, an operation panel 15, a coin tray 16 are provided below the front panel 11, while a start lever 17 is provided at the lateral side of the slot game machine 2.

The operation panel 15 has buttons such as a bet button 18 and a payout button. When the bet button 18 is operated to select the number of coins to be bet, the winning line to be validated is determined. For example, one winning line is validated when one coin is bet, and eight winning lines are validated in maximum betting. Then, the game is started by the operation of the start lever 17, and each reel automatically stops at stop positions to display the symbols determined in accordance with random numbers sampled in advance. If a winning symbol combination stops on the winning line or a winning symbol is displayed, dividend coins are dispensed to the coin tray 16. The amount of the dividend coins is determined based on the type of the win.

Figure 2:
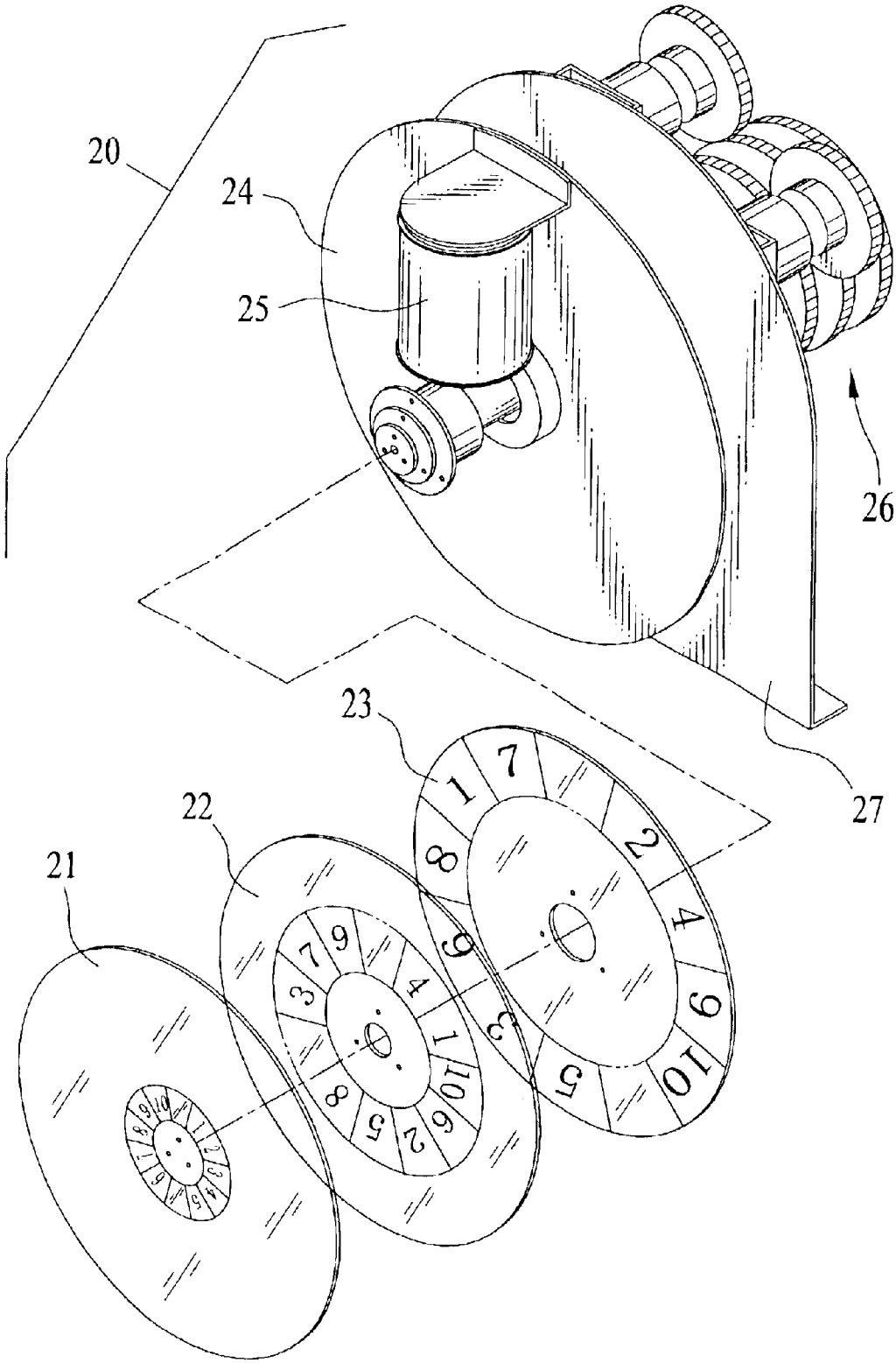
FIG. 2 is a perspective view of the symbol display device.

A symbol display device 20 mounted in the slot game machine 2 is disposed above the front panel 11. The symbol display device 20 executes the roulette game (sub game) if the player wins in the slot game (main game) using the reels. As shown in FIG. 2, the symbol display device 20 is a unit composed of first, second and third display plates 21, 22 and 23, a reel mounting plate (rotator) 24, a sub reel 25, a display driver 26 and a support plate 27. The symbol display device 20 is covered with a front door 30 (see FIG. 1). Besides the sub game device, the symbol display device 20 may be utilized as means to determine the amount of the dividend coins, for instance.

Figure 3:
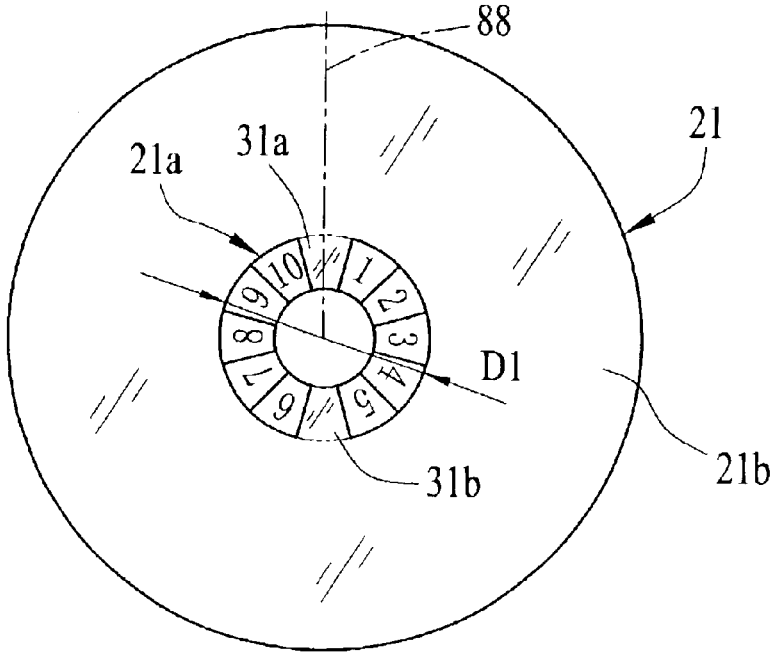
FIGS. 3, 4 and 5 are front views illustrating an example of a first, a second and a third display plates, respectively.
Figure 4:
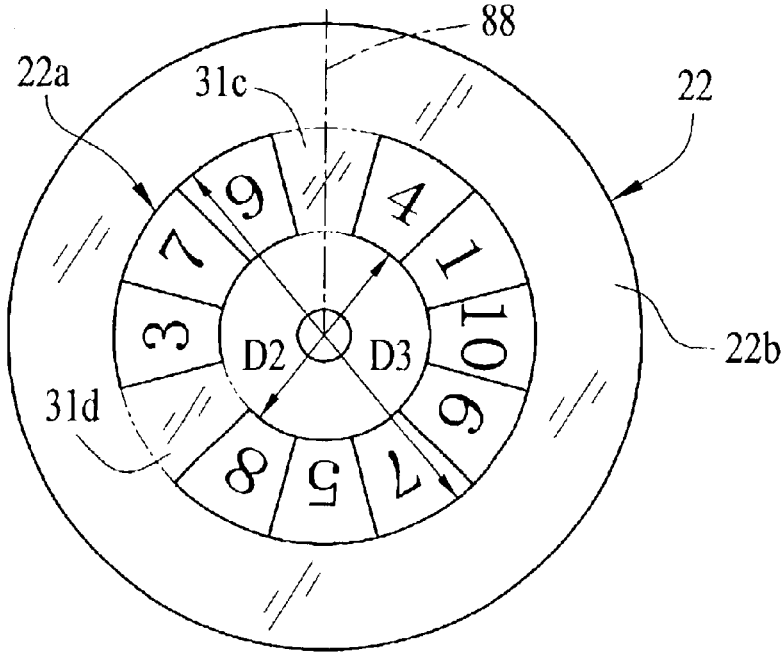
Figure 5:
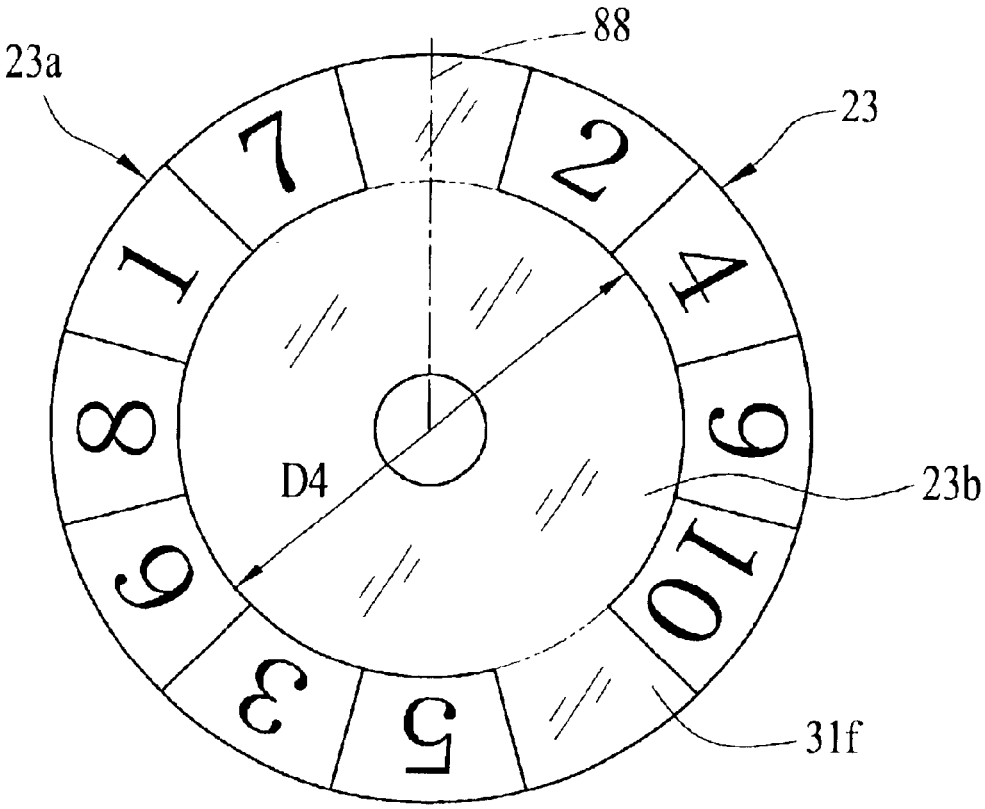

As shown in from FIG. 3 to FIG. 5, each of the first, second and third display plates 21, 22 and 23 are respectively composed of transparent circular plate having the same diameter. A first, second and third display parts 21*a*, 22*a* and 23*a* are provided in the first, second and third display plates 21, 22 and 23, respectively. The first display part 21*a* in the first display plate 21 is the smallest while the third display part 23*a* in the third display plate 23 is the largest. The outer diameter D1 of the first display part 21*a* has the same length as the inner diameter D2 of the second display part 22*a*, while the outer diameter D3 of the second display part 22*a* has the same length as the inner diameter D4 of the third display part 23*a*.

The second display plate 22 is disposed in front of the third display plate 23, and the first display plate 21 is disposed in front of the second display plate 22. The third display plate 23 is disposed in front of a sub reel 25. The first, second and third display plates 21, 22 and 23 are concentrically attached to the display driver 26. Note that the display part 22*a* of the second display plate 22 is observable through the transparent part 21*b* of the first display plate 21, and the display part 23*a* of the third display plate 23 is observable through the transparent part 21*b* of the first display plate 21 and the transparent part 22*b* of the second display plate 22. Thereby, the first, second and third display parts 21*a*, 22*a* and 23*a* are disposed concentrically and adjacent to each other (see FIG. 11). The first, second and third display plates 21, 22 and 23 operate as main display means.

Each of the display parts 21*a*, 22*a* and 23*a* is divided into plural parts corresponding to the number of the disposed symbols. For example, each display is divided into twelve parts for number symbols of "1" to "10" and two blank symbols. Note that the blank symbol is a cell having no symbol. The blank symbols 31*a*, 31*b* are disposed on the first display part 21*a*, the blank symbols 31*c*, 31*d* are disposed on the second display part 22*a*, and the blank symbols 31*e*, 31*f* are disposed on the third display part 23*a*. The blank symbols 31*a* to 31*f* are transparent so that at least one symbol on the display part behind the blank symbol is observable through the blank symbol. Twelve symbols on the first, second and third display plate parts 21*a*, 22*a* and 23*a*, form a winning line in radial directions (indicated by numerals from 120 to 131 in FIG. 11). Note that the first-third display parts 21*a*, 22*a* and 23*a* may have other symbol type than the number in the above embodiment. Examples of other symbol type are marks, signs, color and pictures. Arrangement and the number of the symbols including the blank symbols on the display parts 21*a*, 22*a* and 23*a* are not limited in the embodiment shown in FIGS. 3, 4 and 5, but may be determined appropriately. Furthermore, though borderlines between the blank symbols and the transparent parts are shown by chain double-dashed lines, it is possible to omit the borderlines.

The reel mounting plate 24 is disposed behind and concentrically with the first, second and third display plates 21, 22 and 23. The sub reel 25 is mounted on the reel mounting plate 24. The reel mounting plate 24 is rotated when the blank symbols of first, second and third display parts 21*a*, 22*a* and 23*a* is arranged in line on any of winning lines 120 to 131 when the first-third displays 21, 22 and 23 stop rotating. In addition, the reel mounting plate 24 shifts the sub reel 25 behind the blank symbols on the winning line.

Figure 6:
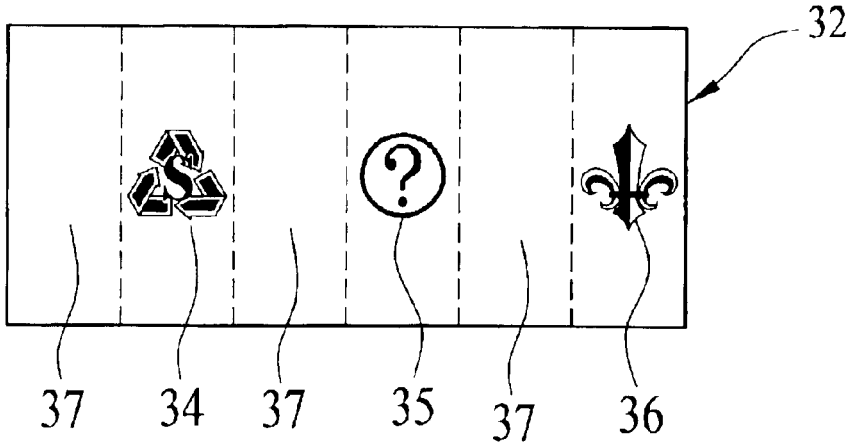
FIG. 6 is a front view illustrating an example of a symbol sheet attached to a periphery of a sub reel.

The sub reel 25 is disposed behind the first, second and third displays 21, 22 and 23 such that the axial direction coincides the radial direction of the reel mounting plate 24 and crosses the first, second and third display parts 21*a*, 22*a* and 23*a*. As shown in FIG. 6, a symbol sheet 32, whereon plural symbols 34, 35 and 36 and the blank symbols 37 are disposed alternately, is attached to the sub reel 25. The symbols 34, 35 and 36 respectively represent the win, the loss and re-rotation of the first, second and third display plates 21, 22 and 23. Although dotted lines are used as the borderlines between the symbols 34 to 36 and the blank symbols 37 so as to distinguish them from each other, it is possible to omit the borderlines.

The sub reel 25 normally displays the blank symbol 37 when it is not rotating. If the blank symbols of the display plates 21, 22 and 23 are arranged in line, the reel mounting plate 24 starts rotating and shifts the sub reel 25 to the position behind the blank symbols. Then, the sub reel 25 starts rotating and stops to display a symbol representing the win, the loss or the re-rotation of the display plates 21, 22 and 23 through the blank symbols. Thus, the sub reel 25 functions as sub display means.

Figure 7:
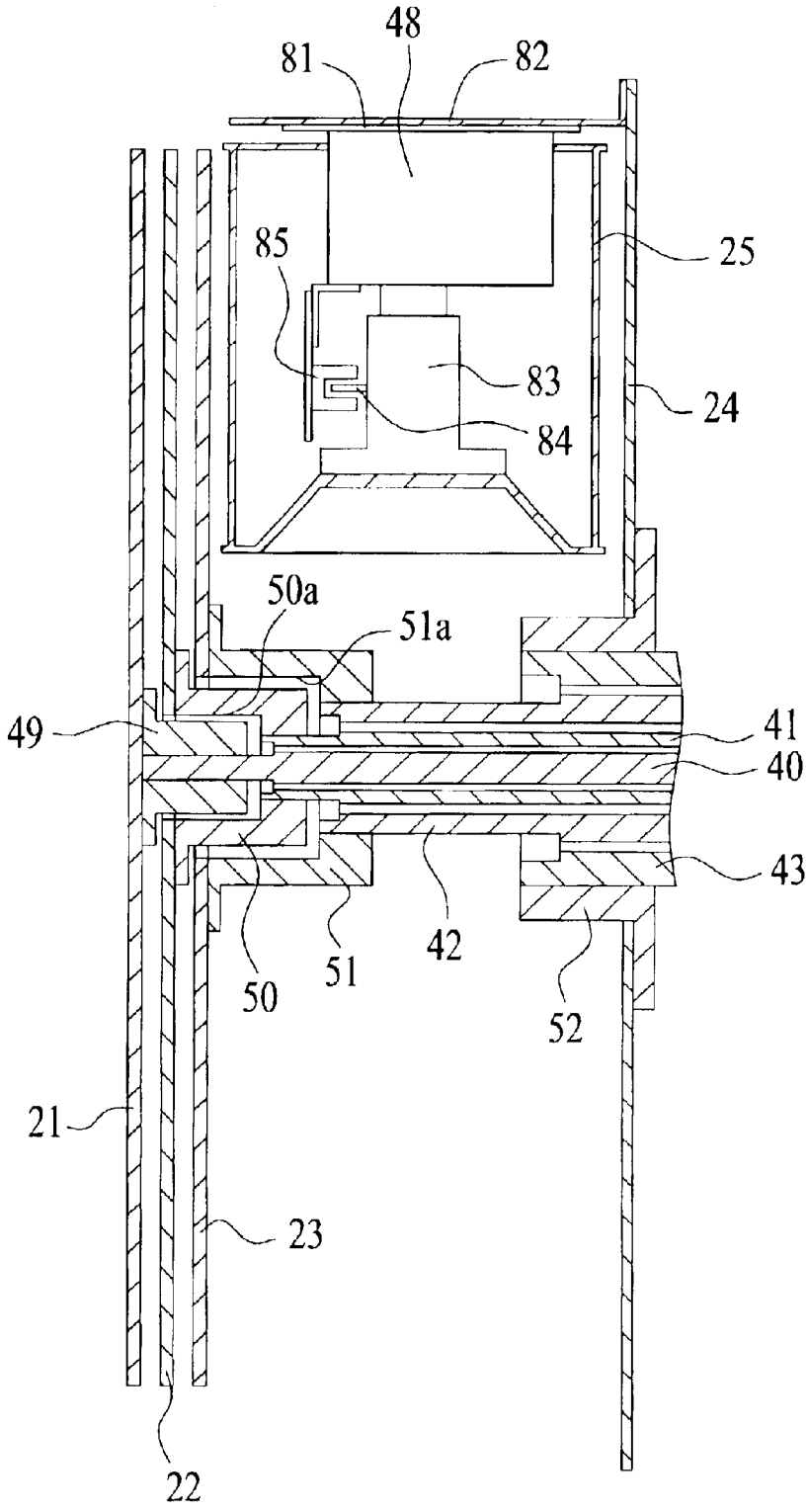
FIG. 7 and 8 are partial cross sections illustrating a composition of the symbols display device.
Figure 8:
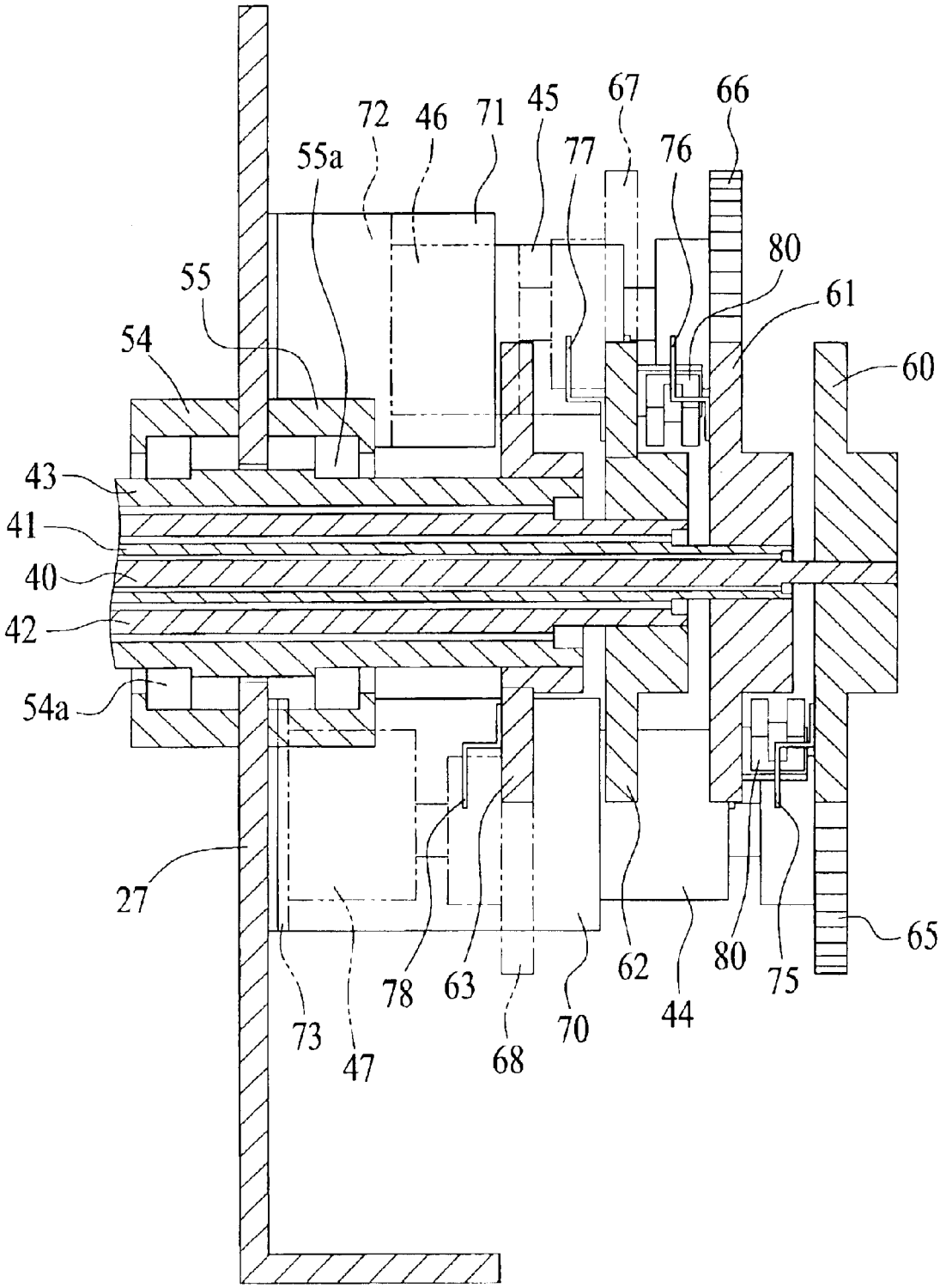

As shown in FIGS. 7 and 8, the display driver 26 is provided with first, second, third and fourth rotary shafts 40, 41, 42 and 43 and first, second, third, fourth and fifth drive motors 44, 45, 46, 47 and 48. The rotary shafts except the first rotary shaft 40 have tubular shapes. The first to third displays 21, 22 and 23 and the reel mounting plate 24 are firmly screwed to first, second, third and fourth flanges 49, 50, 51 and 52 that are fixed to the one ends of the first to fourth rotary shafts 40, 41. 42 and 43, respectively. A portion of the first flange 49 is fitted into a concave part 50*a* formed in the second flange 50. A portion of the second flange 50 is fitted into a concave part 51*a* formed in the third flange 51.

The first rotary shaft 40 is inserted into the hollow part of the second rotary shaft 41 and determined its position by bearings (not shown) attached to both ends of the second rotary shaft 41. Thereby, the first rotary shaft 40 and the second rotary shaft 41 are held concentrically, so are the first display plate 21 and the second display plate 22. Similarly, the second rotary shaft 41 is inserted into the hollow part of the third rotary shaft 42 and determined its position by the bearings (not shown) attached to both ends of the third rotary shaft 42. Thereby, the second rotary shaft 41 and the third rotary shaft 42 are held concentrically, so are the second display plate 22 and the third display plate 23. The third rotary shaft 42 is inserted into the hollow part of the fourth rotary shaft 43 and determined its position by the bearings (not shown) attached to both ends of the fourth rotary shaft 43. Thereby, the third rotary shaft 42 and the fourth rotary shaft 43 are held concentrically, so are the third display plate 23 and the reel mounting plate 24.

Accordingly, the first-fourth rotary shafts 40, 41, 42, and 43 are held concentrically, and the first-third displays 21, 22 and 23 and the reel mounting plate 24 are held concentrically as well. The fourth rotary shaft 43 is fixed to the support plate 27 by bearing members 54 and 55. Note that the reference numerical 54*a* and 55*a* represent bearings to enable smooth rotation of the fourth rotary shaft 43. Gears 60, 61, 62 and 63 are respectively fixed to the other ends of the first to fourth rotary shafts 40, 41, 42 and 43.

Each of the first to fourth drive motors 44, 45, 46, and 47 is a stepping motor driven by drive pulses, and rotates the first-third displays 21, 22 and 23 and the reel mounting plate 24. Gears 65, 66, 67, and 68 fixed to the drive shafts of corresponding drive motors are respectively in mesh with the gears 60, 61, 62 and 63 of the first to fourth rotary shafts 40, 41, 42, and 43. Drive force of the first to fourth drive motors 44, 45, 46 and 47 is transmitted to the first to fourth rotary shafts 40, 41, 42 and 43 so as to rotate the first to third displays 21, 22 and 23 and the reel mounting plate 24 individually. Each of the first to fourth drive motors 44, 45, 46 and 47 is respectively held by brackets 70, 71, 72 and 73 and fixed to the rear side of the support plate 27.

Each of the gears 60, 61, 62 and 63 is provided with position detecting segments 75, 76, 77 and 78 to indicate standard positions of the first to third displays 21, 22 and 23 and the reel mounting plate 24. Photo interrupters 80 mounted on each drive motors detects the position detecting segments 75, 76, 77 and 78 so as to detect that the first to fourth rotary shafts 40, 41, 42 and 43 rotate by 360 degrees.

Similarly, the photo interrupter 80 detects the position detecting segment 78 to detect that the sub reel 25 mounted on the reel mounting plate 24 makes one rotation. Note that the photo interrupters mounted to the drive motors 46 and 47 are not shown to avoid complication of the drawing. Note that, in the present embodiment, the blank symbols 31*a*, 31*c* and 31*e* on the first to third display parts 21*a*, 22*a* and 23*a* are respectively on a standard line 88 when the position detecting segments 75, 76 and 77 are detected by each photo interrupter 80 (see FIGS. 3, 4 and 5). The sub reel 25 is on the standard line 88 when the position detecting segment 78 is detected by the photo interrupter 80 (see FIG. 11).

The fifth drive motor 48 is fixed to the reel mounting plate 24 by brackets 81 and 82. The sub reel 25 is fixed to the drive shaft of the fifth drive motor 48 by a flange 83. Thereby, drive force of the fifth drive motor 48 is transmitted to the sub reel 25. The photo interrupter 85 detects the position detecting segment 84, which is fixed to the flange 83, so as to detect the rotation of the sub reel 25. Note that, in the present embodiment, the winning symbol 34 in the sub reel 25 is displayed behind the third display plate 23 when the position detecting segment 84 is detected by the photo interrupter 85.

Since the display driver 26 is fixed to the support plate 27 as one unit, the symbol display device 20 becomes small. Moreover, it is possible to improve workability, because the symbol display device 20 is easily mounted in the slot game machine 2 just by mounting the support plate 27 to a predetermined position and it improves the workability as well. Note that the composition of the display driver 26 is not limited in the above embodiment but other mechanism may be utilized. For example, a pulley and a toothed belt may be used instead of the gears.

Figure 9:
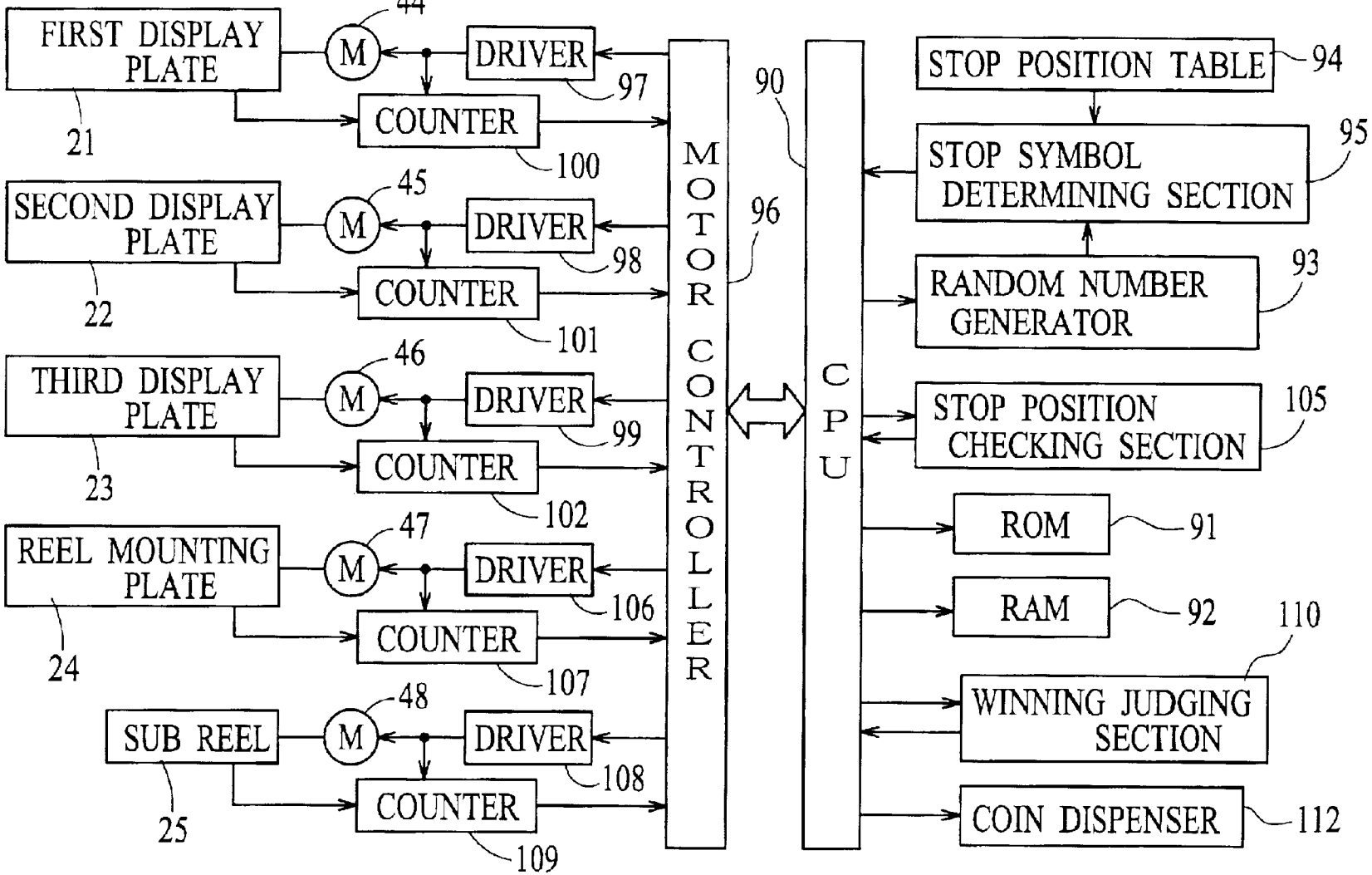
FIG. 9 is a functional block view illustrating a part of an electrical composition of the slot machine.

FIG. 9 is a functional block diagram showing an electrical configuration of a part of the slot game machine 2 for executing roulette game. Note that an explanation and drawing of a part for executing slot game are omitted. A CPU 90 controls each section in accordance with a roulette game program stored in a ROM 91 when the player wins in the slot game.

The ROM 91 stores pulse number data to specify the number of the drive pulse of the drive motors 44, 45 and 46 to rotate the first to third display plates 21, 22 and 23 by predetermined angle. On receiving a game start signal from the CPU 90, a random number generator 93 samples a random number and outputs it to a stop symbol determining section 94. The stop symbol determining section 94 determines the stop positions for the blank symbols 31*a*, 31*c* and 31*e* in the first to third display parts 21*a*, 22*a* and 23*a* with reference to a stop position table 95. The stop symbol determining section 94 obtains pulse number data for the first, second and third display plates 21, 22 and 23 from the ROM 91 such that the blank symbols 31*a*, 31*c* and 31*e* reach the respective stop positions.

A motor controller 96, operated in response to the game start signal from the CPU 90, drives the first to third drive motors 44, 45 and 46 through the drivers 97, 98 and 99. Each of counters 100, 101 and 102 counts the number of each of the drive pulse inputted to the first to third drive motors 44, 45 and 46. By monitoring the number of the drive pulses, the motor controller 96 specifies the positions of the blank symbols 31*a*, 31*c* and 31*e*. The CPU 90 outputs a rotation stop signal to the motor controller 96 when the counters 100, 101 and 102 count the same pulse numbers as the ones stored in the RAM 92. In response to the rotation stop signal, the motor controller 96 stops driving of the first to third drive motors 44, 45 and 46. Note that the count values of the counters 100, 101 and 102 is reset respectively at the time when the photo interrupters 80 detect the position detecting segments 75, 76, 77.

Referring to the count values of the counters 100, 101 and 102, a stop position checking section 105 checks whether the blank symbols on the first to third display parts 21*a*, 22*a* and 23*a* stop in line on any of winning lines 120 to 131. If the stop position checking section 105 recognizes that the blank symbols stop in line on any of the winning lines 120 to 131, the motor controller 96 drives the fourth drive motor 47 through a driver 106.

The sub reel 24 is located at a position in which the rotary shaft of the sub reel 25 is overlapped with one of the winning lines 120 to 131. The ROM 91 stores pulse number data for the fourth drive motor 47 to rotate the sub reel 24 by predetermined angle. The motor controller 96 stops the fourth drive motor 47 when the count value of the counter 107 reaches the pulse number for the winning line with three blank symbols in line. Note that the count value of the counter 107 is reset at the time when the photo interrupter 80 detects the position detecting segment 78.

Then, the motor controller 96 drives the fifth drive motor 48 through a driver 108 to start rotating the sub reel 25. The CPU 90 reads pulse number data for the fifth drive motor 48, stored in the ROM 91, to rotate the sub reel 25 by predetermined angle. The motor controller 96 stops the fifth drive motor 48 when the count value counted by a counter 109 reaches the pulse number. Note that the count value of the counter 109 is reset at the time when the photo interrupter 85 detects the position detecting segment 84.

A winning judging section 110 judges whether there is a winning symbol combination in a radial direction when the first to third displays 21, 22 and 23 stop rotation. The ROM 91 stores winning count value data for the counters 81, 82 and 83 at the time when winning symbol combinations are appeared on the winning lines 120 to 131. The winning judging section 110 refers the count value of the counters 81, 82 and 83 to judge whether there is a winning symbol combination. In addition, the winning judging section 110 judges the win or the loss based on the count value of the counter 109 when the sub reel 25 stops rotation. If the winning judging section 110 judges that the re-rotation symbol 36 is displayed, the CPU 90 operates a random number generator 93 again. If the winning judging section 110 judges the win, the CPU 90 operates a coin dispenser 112 to dispense dividend coins, whose amount is determined based on the type of the win.

Figure 10:
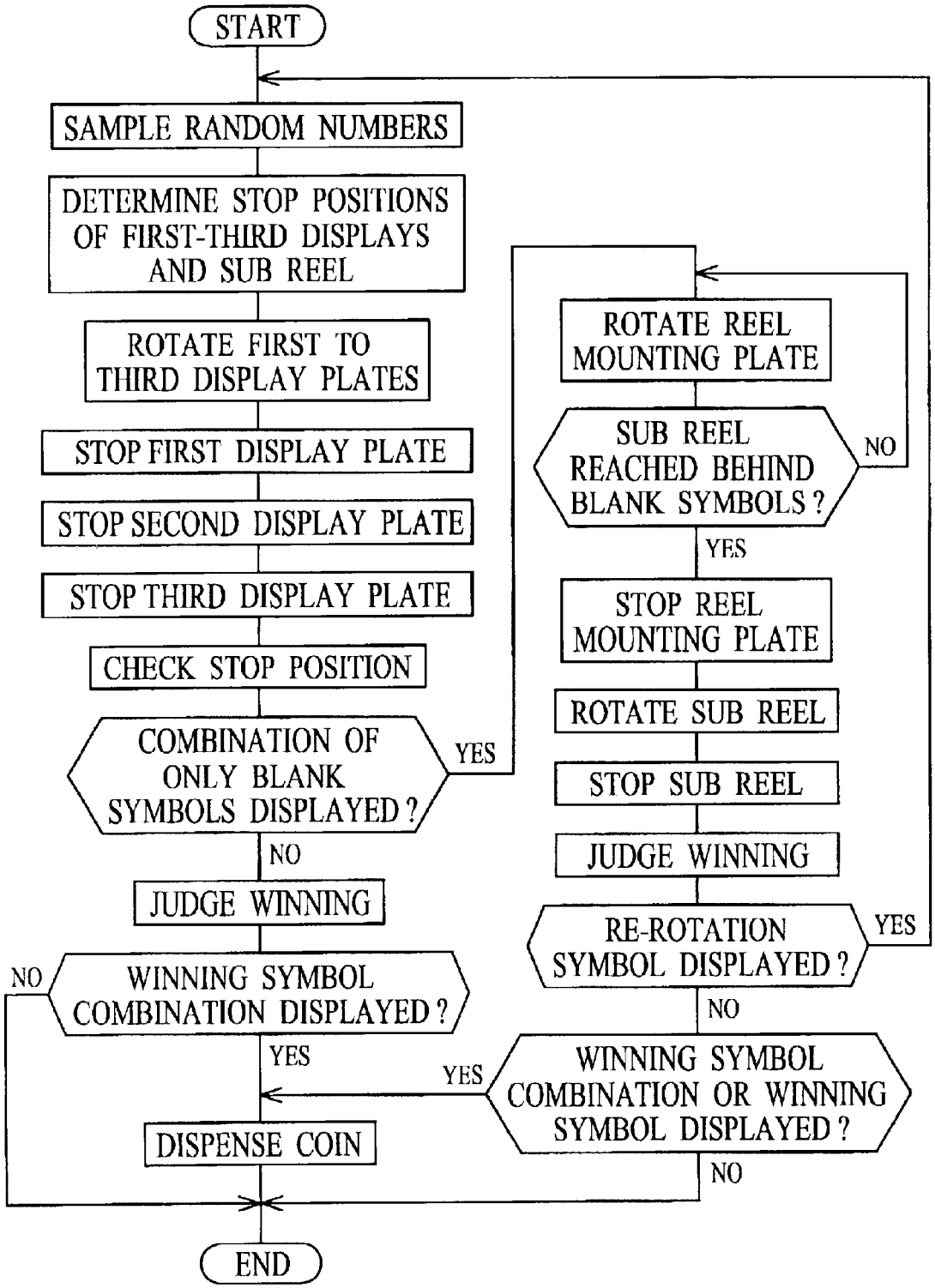
FIG. 10 is a flow chart showing the process of a sub game.

The function of the slot game machine, wherein the symbol display device structured as described above is mounted, is explained with reference to the flow chart of FIG. 10. Note that the explanation about the slot game as the main game is omitted so that only the roulette game as the sub game is explained.

If the player wins in the main game, the CPU 90 operates the random number generator 93 to sample a random number. Based on the sampled random number, the stop symbol determining section 94 determines the stop positions of the blank symbols 31*a*, 31*c* and 31*e* and the symbol 34 of the sub reel 24, which are temporarily stored in the RAM 92. Simultaneously, the CPU 90 operates the motor controller 96 to rotate the first to third display plates 21, 22 and 23 through the first to third drive motors 44, 45 and 46.

After the first to third display plates 21, 22 and 23 start rotating, the CPU 90 stops the first display plate 21 first, then the second display plate 22, and the third display plate 23 at last, by use of a random timer section (not shown). After all of the first to third display plates 21, 22 and 23 stop rotating, the CPU 90 operates the stop position checking section 105 to check whether the blank symbols of the first to third display parts 21*a*, 22*a* and 23*a* stop in line on any of the winning lines from 120 to 131.

Figure 11:
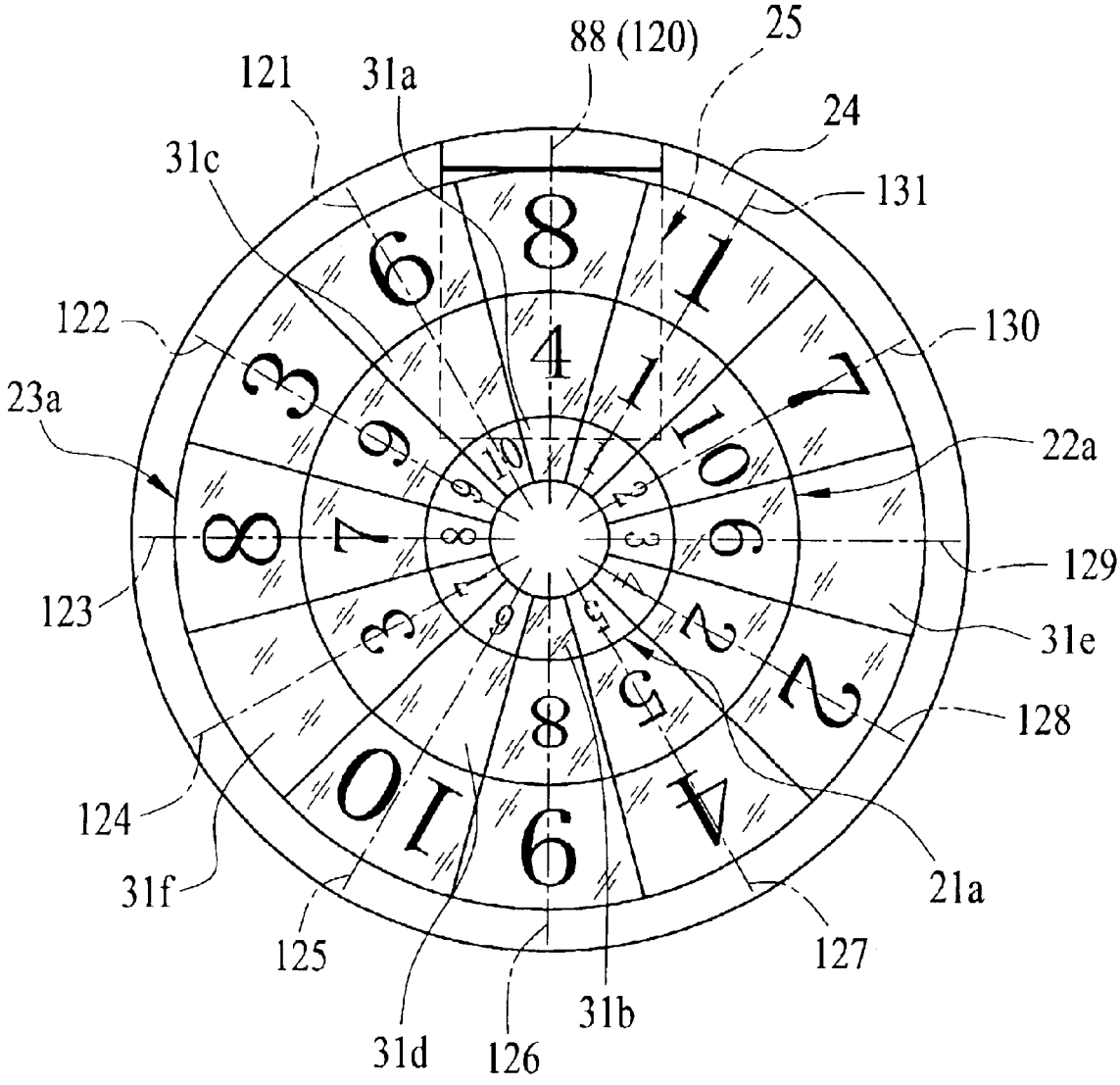
FIG. 11 is a front view illustrating an example of a winning symbol combination of first-third display parts.
Figure 12:
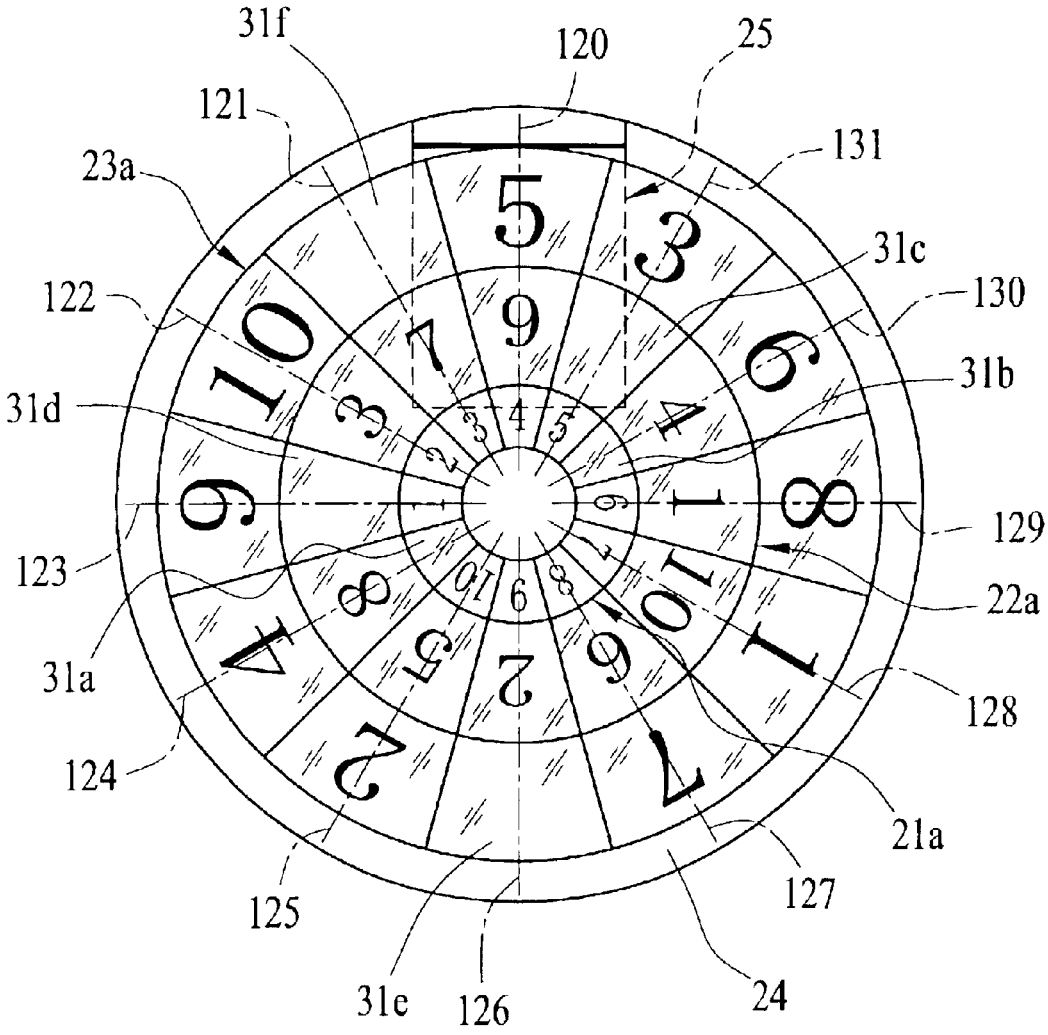
FIG. 12 is a front view illustrating an example of a losing symbol combination of the first-third display parts.

If the blank symbols are not arranged in line on any of the winning lines from 120 to 131, the CPU 90 operates the winning judging section 110 to judge (to execute winning judgment) whether the same symbols stop in line on any of the winning lines from 120 to 131. For example, as shown in FIG. 11, if the symbols "1" of the first-third display parts 21*a*, 22*a* and 23*a* are arranged on the winning line 131, the CPU 90 judges the win and drive the coin dispenser 112 to dispense the dividend coins. The amount of dispensed coins is determined based on the type of the win. If the same symbols do not stop in line on any of the winning lines from 120 to 131 as shown in FIG. 12, the CPU 90 judges the loss and finishes the game.

Figure 13:
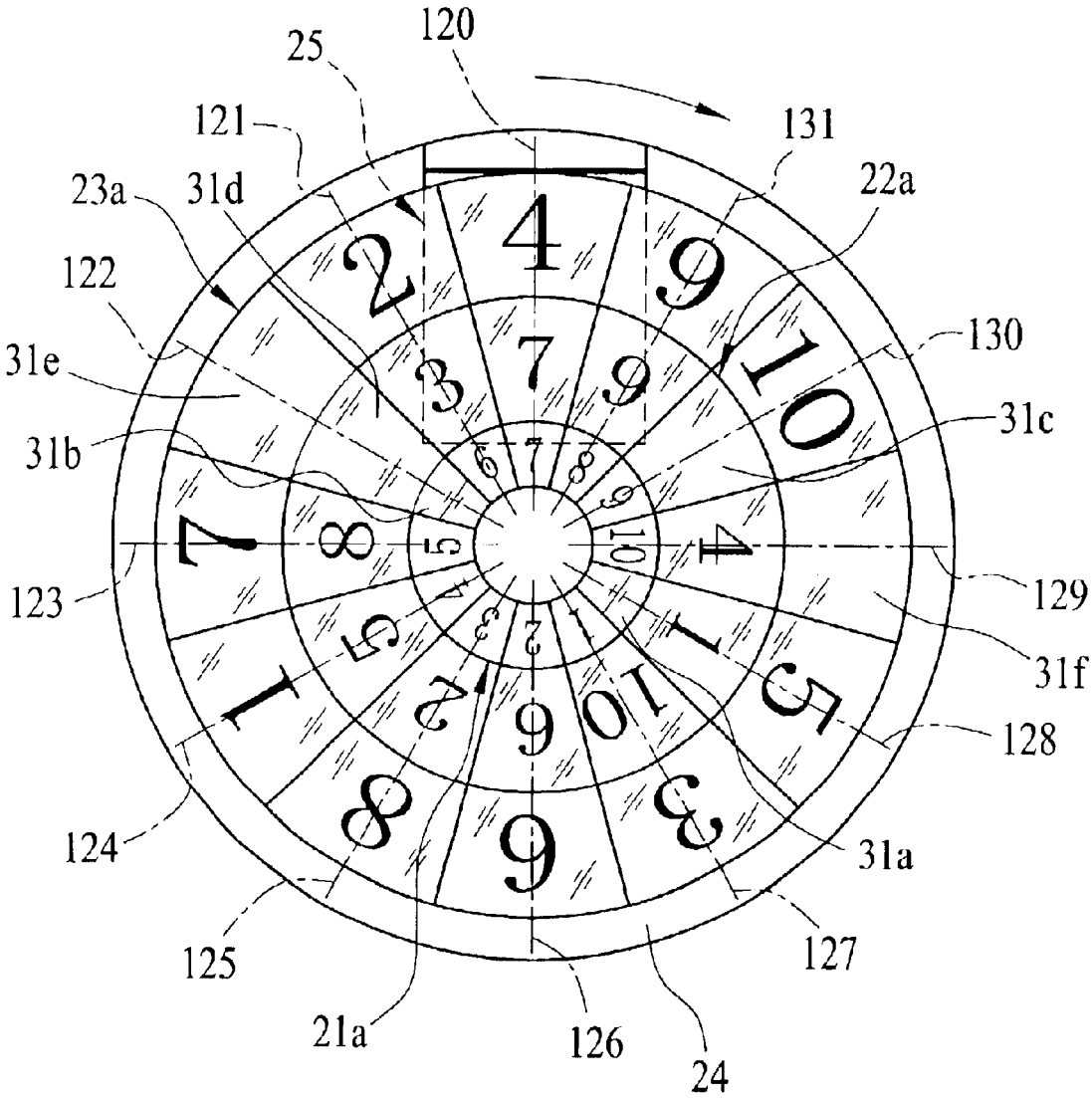
FIG. 13 is a front view illustrating an example wherein blank symbols are arranged in line on a winning line.
Figure 14:
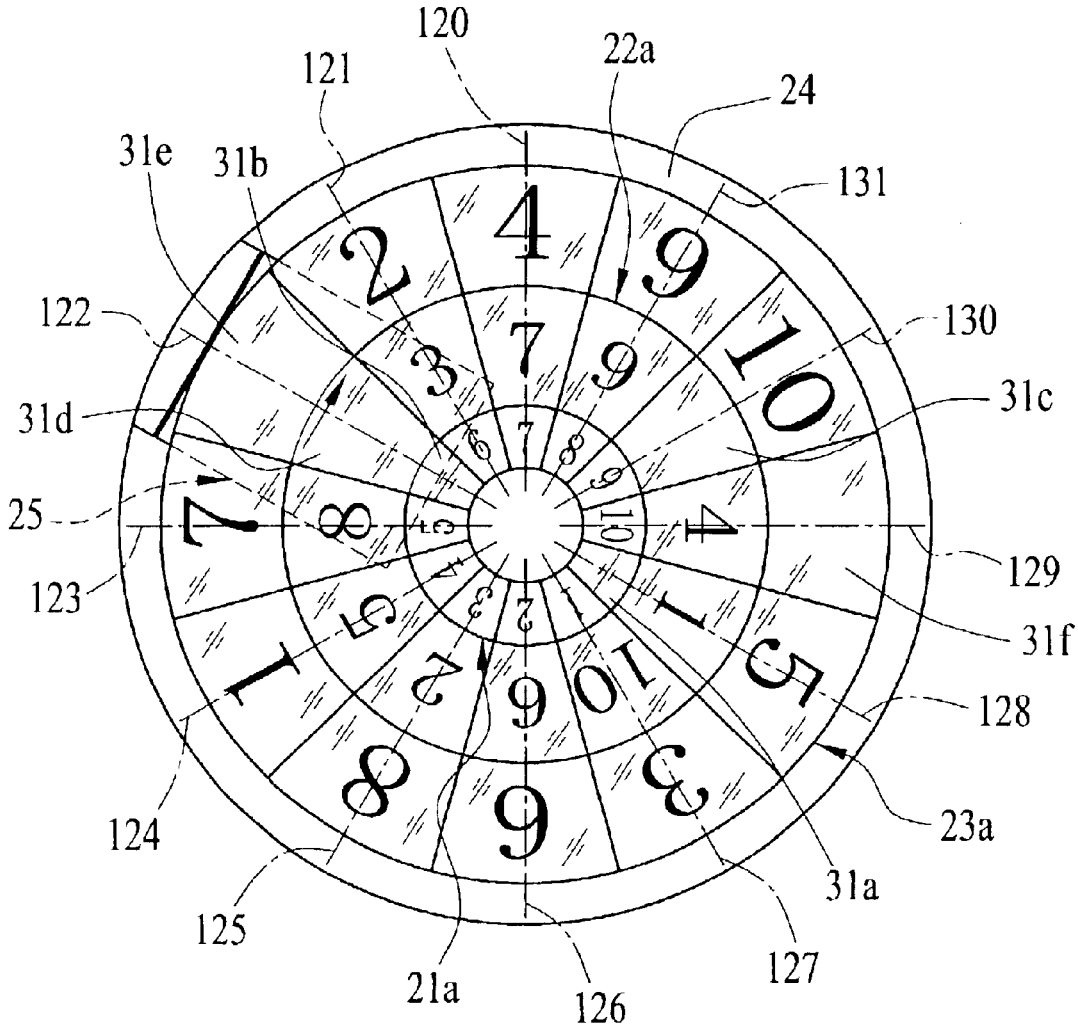
FIG. 14 is a front view illustrating an example wherein a reel mounting plate is rotated to shift the sub reel behind the blank symbols.

On the other hand, if the blank symbols 31*b*, 31*d* and 31*e* stop in line on the winning line 122, as shown in FIG. 13, the CPU 90 drives the fourth drive motor 47 through the motor controller 96 to rotate the reel mounting plate 24. Then, the CPU 90 stops the fourth drive motor 47 when the sub reel 25 reaches the position behind the blank symbols 31*b*. 31*d* and 31*e*, as shown in FIG. 14. When the reel mounting plate 24 stops rotating, the motor controller 96 operates the fifth drive motor 48 to rotate the sub reel 25 and stops it after a predetermined time. When the sub reel 25 stops the rotation, one of the symbols of the sub reel 25 is displayed through the blank symbols 31*b*, 31*d* and 31*e*. If the blank symbols are arranged on the same winning line as the last game, the reel mounting plate 24 rotates by 360 degrees and then stops at the same position.

Figure 15:
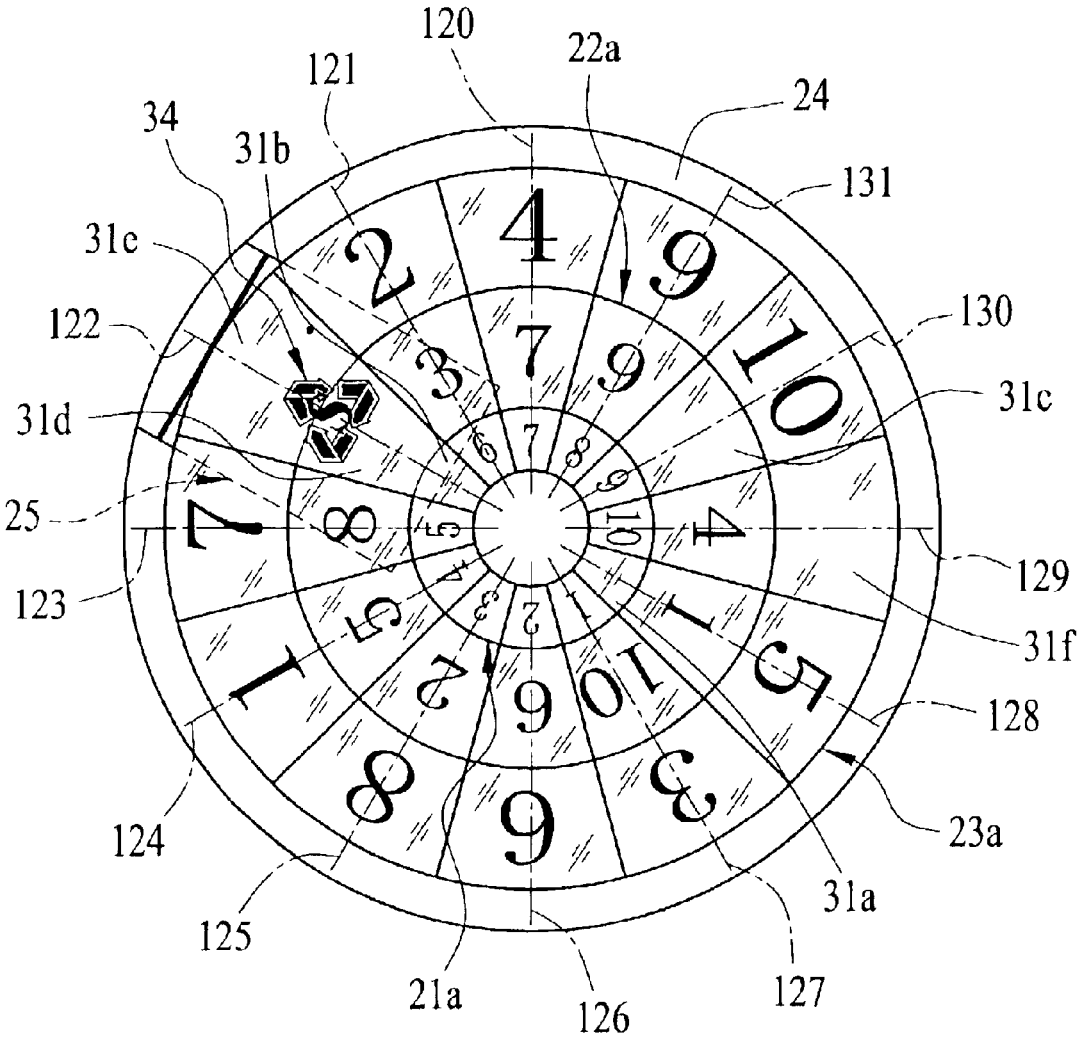
FIG. 15 is a front view illustrating an example wherein a winning symbol is displayed when the sub reel stops.

After the sub reel 25 stops rotating, the winning judging section 110 refers the count values of the counters 100, 101, 102 and 109 to judge whether the combination of the same symbols is displayed on any of the winning lines 120 to 131 or whether the winning symbol 34 is displayed. As shown in FIG. 15, for example, if no combination of the same symbols stops on any of the winning lines from 120 to 131, the player loses in terms of the combination of the symbols. However, since the winning symbol 34 of the sub reel 25 is displayed through the blank symbols 31*b*, 31*d* and 31*e*, the player wins in this game and gets the dividend coins, whose amount is determined based on the type of the win.

Figure 16:
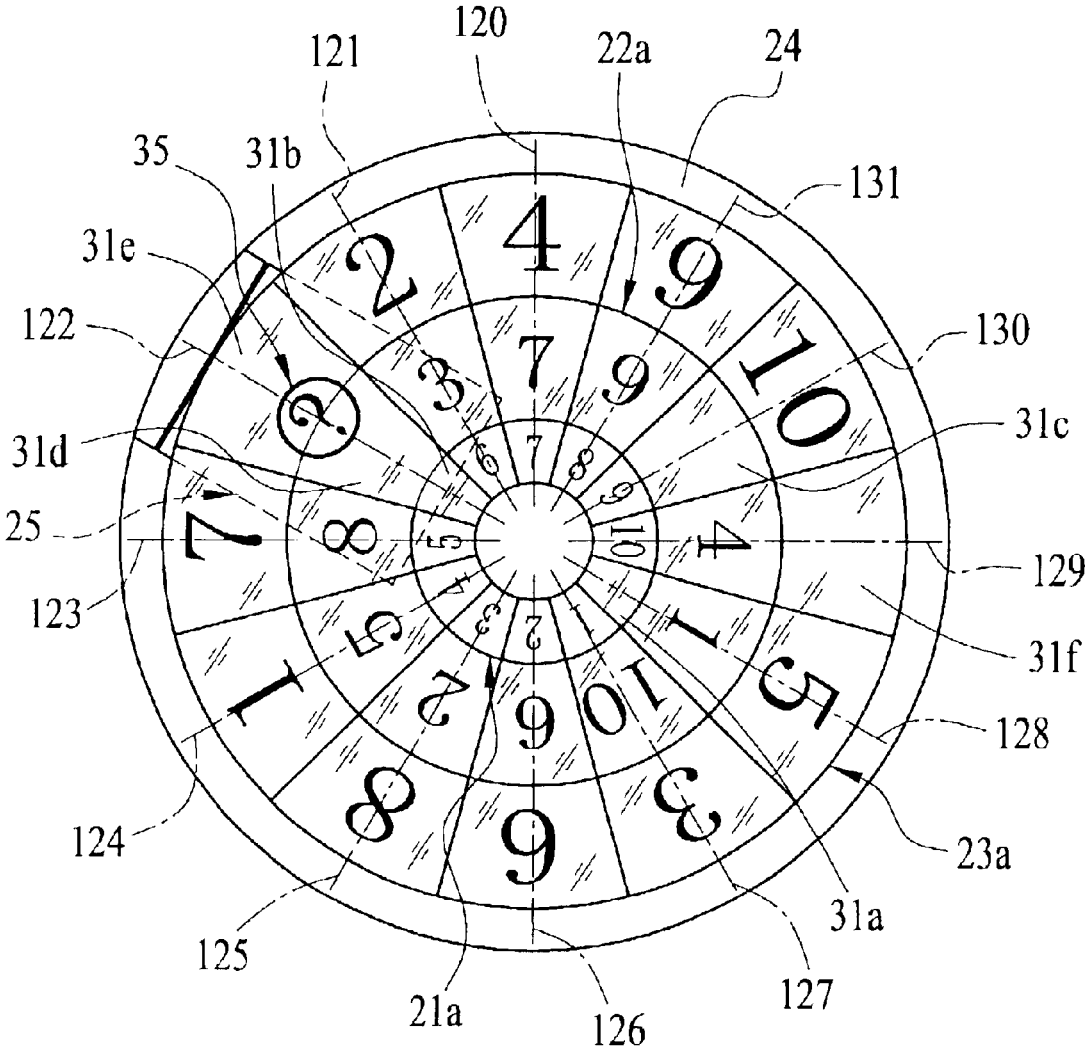
FIG. 16 is a front view illustrating an example wherein a losing symbol is displayed when the sub reel stops.
Figure 17:
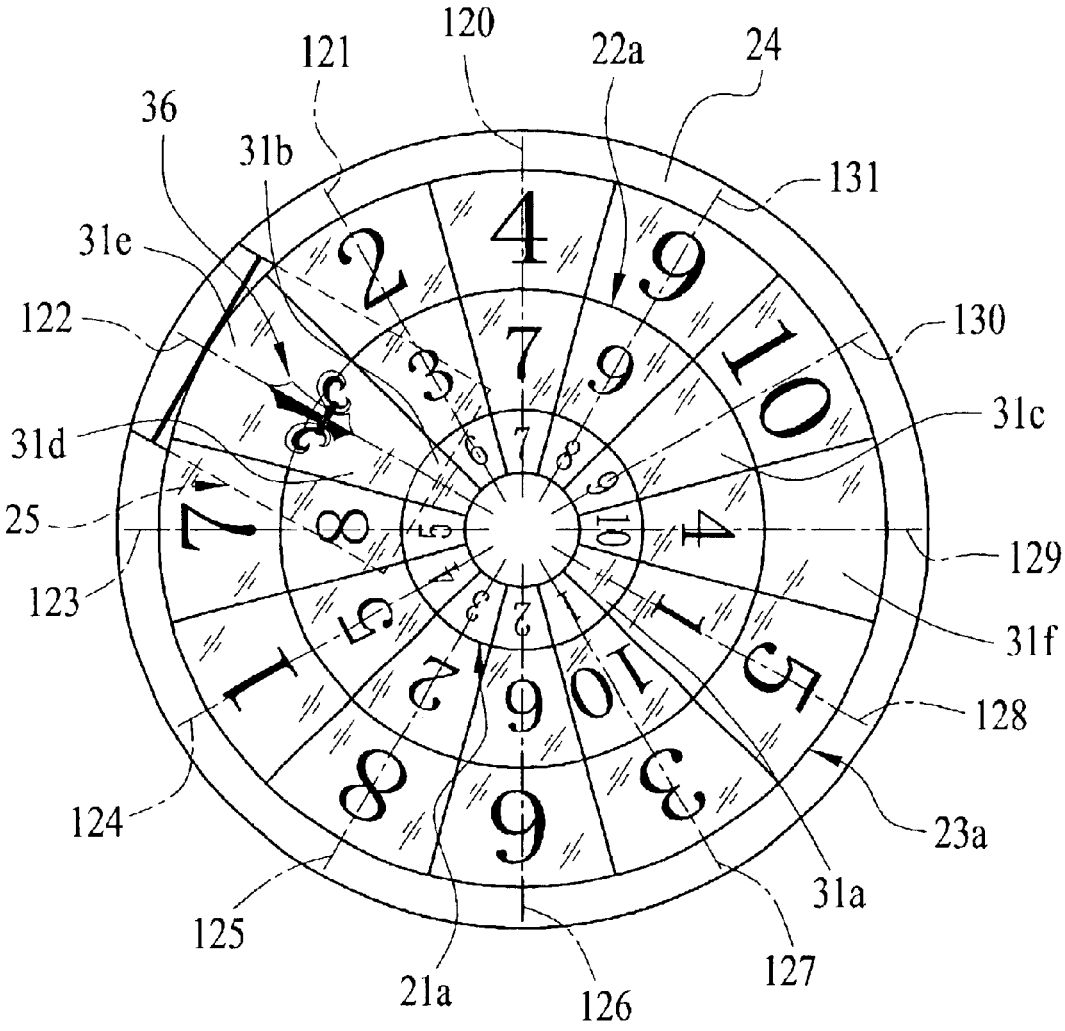
FIG. 17 is a front view illustrating an example wherein a re-rotation symbol is displayed when the sub reel stops.

On the other hand, if the losing symbol 35 of the sub reel 25 is displayed when the sub reel 25 stops rotating as shown in FIG. 16, the player loses in this game. If, as shown in FIG. 17, the re-rotation symbol 36 of the sub reel 25 is displayed when the sub reel 25 stops rotating, the CPU 90 determines the stop positions of the blank symbols 31*a*, 31*c* and 31*e* and the symbol 34 of the sub reel 25 again. Simultaneously, the CPU 90 rotates and stops the first to third displays 21, 22 and 23 through the motor controller 96, in the same manner described above. Then, the CPU 90 rotates and stops the reel mounting plate 24 and the sub reel 25 in the order mentioned if the blank symbols of the first to third display parts 21*a*, 22*a* and 23*a* stop on the same winning line. After the sub reel

25 is stopped, the winning judging section 110 judges whether the win or the loss.

Since two different games in a single symbol display device are associated with each other, a player may continue to have expectation for the win in one game even after losing in the other game. Moreover, such symbol display device can provide sufficient appeal to a player by giving a variety of display types.

The first to third display plates 21, 22 and 23 may be rotated into the same direction, or one of them may be rotated in the opposite direction. It is also possible to change the rotational speed of each of the first to third display plates 21, 22 and 23. The order to stop the rotation of the first to third display plates 21, 22 and 23 is not limited in the above embodiment.

If the two same symbols are arranged on one of the winning lines when two display plates stop rotating, the remaining display plate may rotate slowly or repeat the rotation in the clockwise and counterclockwise directions alternately such that the remaining display plate rotate clockwise little by little. Thereby, the symbol display device may provide a variety of performances to sustain the player's interest. The first to third display plates 21, 22 and 23 and the sub reel 25 may be stopped not only automatically but by the manual operation of the stop button.

Though lightings such as lamps and LEDs are not described in the above embodiment, it is possible to emit light in the front panel 11 during the rotation of the first to third display plates and the sub reel. It is also possible to change the color of emitted light when one of the first to third display panels rotates in the opposite direction as other display panels.

It is possible to move the reel mounting plate 24 to the initial position in which the rotary shaft of the sub reel 25 is overlapped with one of the standard line 88 in FIG. 3.

The display device of the present invention may be composed of two or more than three display panels without losing the effects of the present invention. Note that the symbols other than the blank symbol may be transparent or non-transparent. The display plate is not necessarily transparent except the display part, but the area that overlaps the display part of other display plate may be partially opaque. In this case, the reel mounting plate is rotated to move the sub reel behind the blank symbol only if the blank symbols of the first to third display plates are arranged in line on the same winning line and, simultaneously, the blank symbol is overlapped with the transparent parts of the other display plates. After the reel mounting plate stop rotating, the sub reel is rotated. On the other hand, if the blank symbol is overlapped with the opaque parts of the other display plates, the reel mounting plate is not rotated.

Though the first to third display plates are formed of three rotary disks having the same diameters in the above embodiment, they may have different diameters. The present invention is not limited to the embodiment in which the first display part is the smallest while the third display part is the largest. For instance, the first display part may be the largest while the third display part may be the smallest. The second display part may be the largest among the three display parts. In addition, the first to third display plates may have other shapes, such as polygon.

Although reel mounting plate in the above embodiment is rotated only when the blank symbols on the first to third display parts are arranged in line, the reel mounting plate may be rotated together with the first to third display plates. In this case, the reel mounting plate may rotate in the same direction as the first to third display plates as well as in the opposite direction. In addition, the sub reel may rotate together with the reel mounting plate. The present invention is not limited to the embodiment in which the reel mounting plate is stopped when the sub reel reaches the position behind the blank symbol. For example, the sub reel may be rotated in the opposite direction to the position behind the blank symbol once after passing the blank symbol.

The blank symbol of the sub reel is displayed at the start of the game in the above embodiment. However, any symbols of the sub reel may be displayed initially. When the blank symbols of the first to third display parts stop on the same winning line, whether to rotate the reel mounting plate or the sub reel may be determined by lottery. It is not necessary to stop the sub reel at the position behind the blank symbols of the first to third display parts on the same winning line.

Instead of the sub reel, it is possible to use other display device, such as a liquid crystal display device or a display device of dot matrix style or 7 segments style, to display the symbols and the quasi-movement of the symbols. It is also possible to change the number and position of the sub reel. For example, plural sub reels may be mounted to the reel mounting plate at predetermined intervals or at random intervals. Plural sub reels having different symbols provide various winning types.

Figure 18:
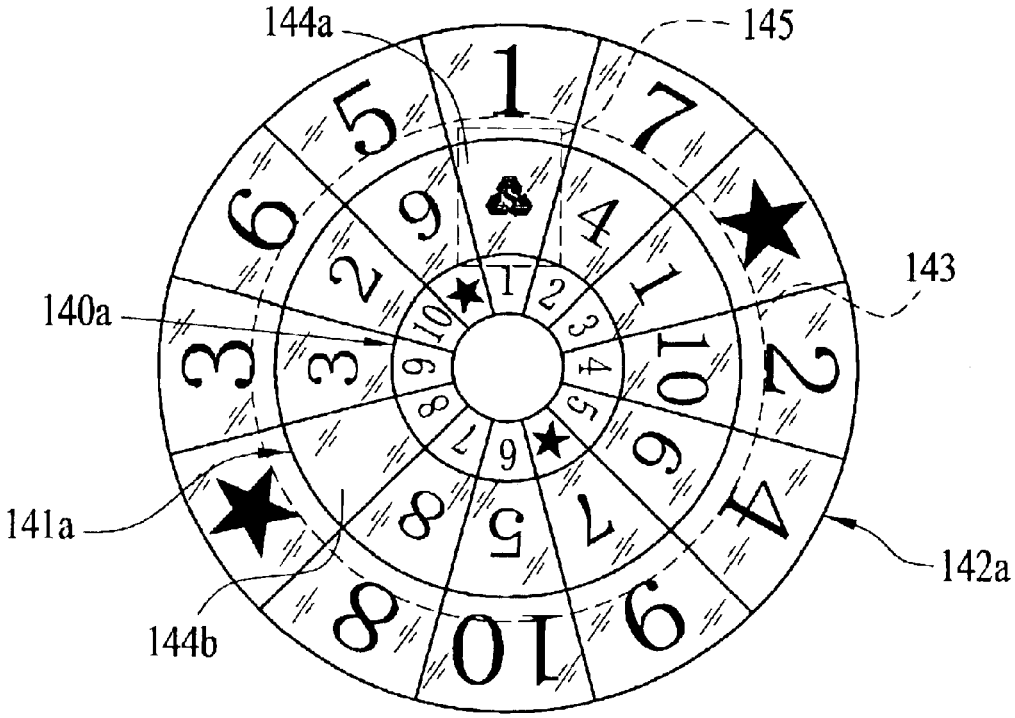
FIG. 18 is a front view illustrating an example wherein the sub reel is displayed behind the second display part.

Although the sub reel is overlapped with the first to third display parts in the above embodiment, the sub reel may be overlapped with only one of the display parts. FIG. 18 shows an example of the sub reel disposed behind the second display part. In this case, a reel mounting plate 143 begins the rotation after first to third display parts 140*a*, 141*a* and 142*a* stop rotating. When the sub reel 145 reaches the predetermined position behind a blank symbol 144*a* of a second display part 141*a*, the sub reel 145 rotates to display symbols in motion and stops rotation. Accordingly, the player may expect the chance to win due to the rotation of the sub reel 145 even after losing the game in the main display means.

The display plate may be partially opaque in the area that overlaps the display part of other display plates. In that case, the reel mounting plate is rotated after the display plates are stopped. When the sub reel is stopped in an area where the blank symbol of one of the display plates is overlapped with the transparent areas of the other two display plates, the sub reel is rotated to display symbols in motion.

Figure 19:
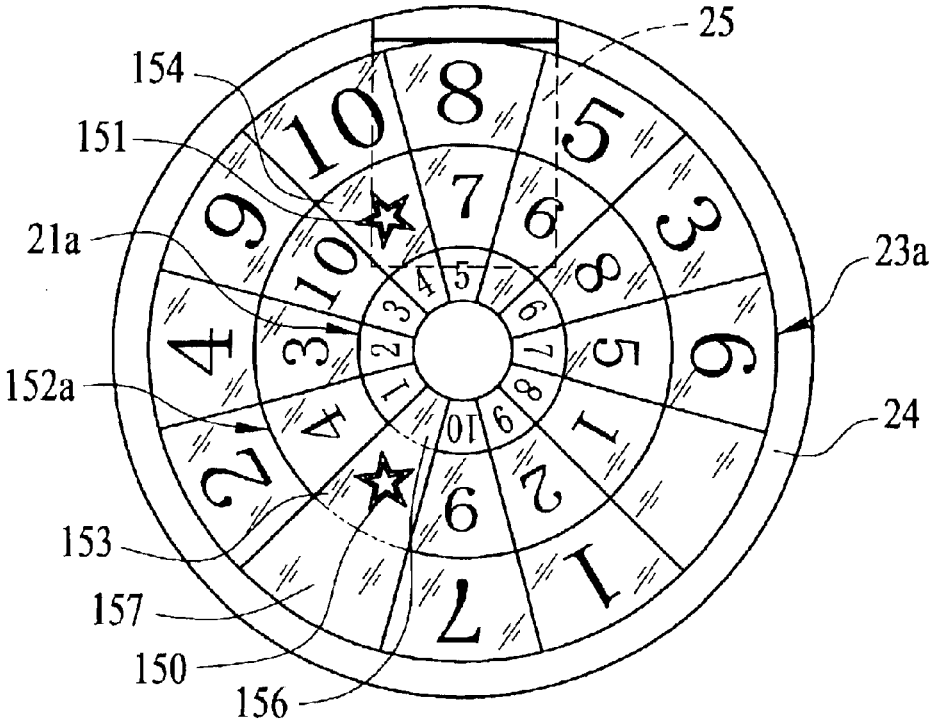
FIG. 19 is a front view illustrating an example wherein the blank symbols and the losing symbol stop in line on a winning line when the first-third display plates stop rotating.

It is possible to provide a composite symbol of the symbol of the sub reel and the symbol in front of the sub reel. In the following explanation, the same elements as those in the above embodiment are represented by the same reference numerals. In FIG. 19, the star symbols 150, 151 and the number symbols "1" to "10" are provided in the second display part 152*a*. The star symbols 150, 151 to represent the loss are disposed respectively in transparent parts 153 and 154. When the star symbol 150 and the blank symbols 156, 157 of the first and third display parts 21*a*, 23*a* are arranged on one of the winning lines, the reel mounting plate 24 is rotated to move the sub reel 25 behind the blank symbols 156 and 157 and the star symbol 150. The sub reel 25 behind the star symbol 150 starts rotating.

Figure 20:
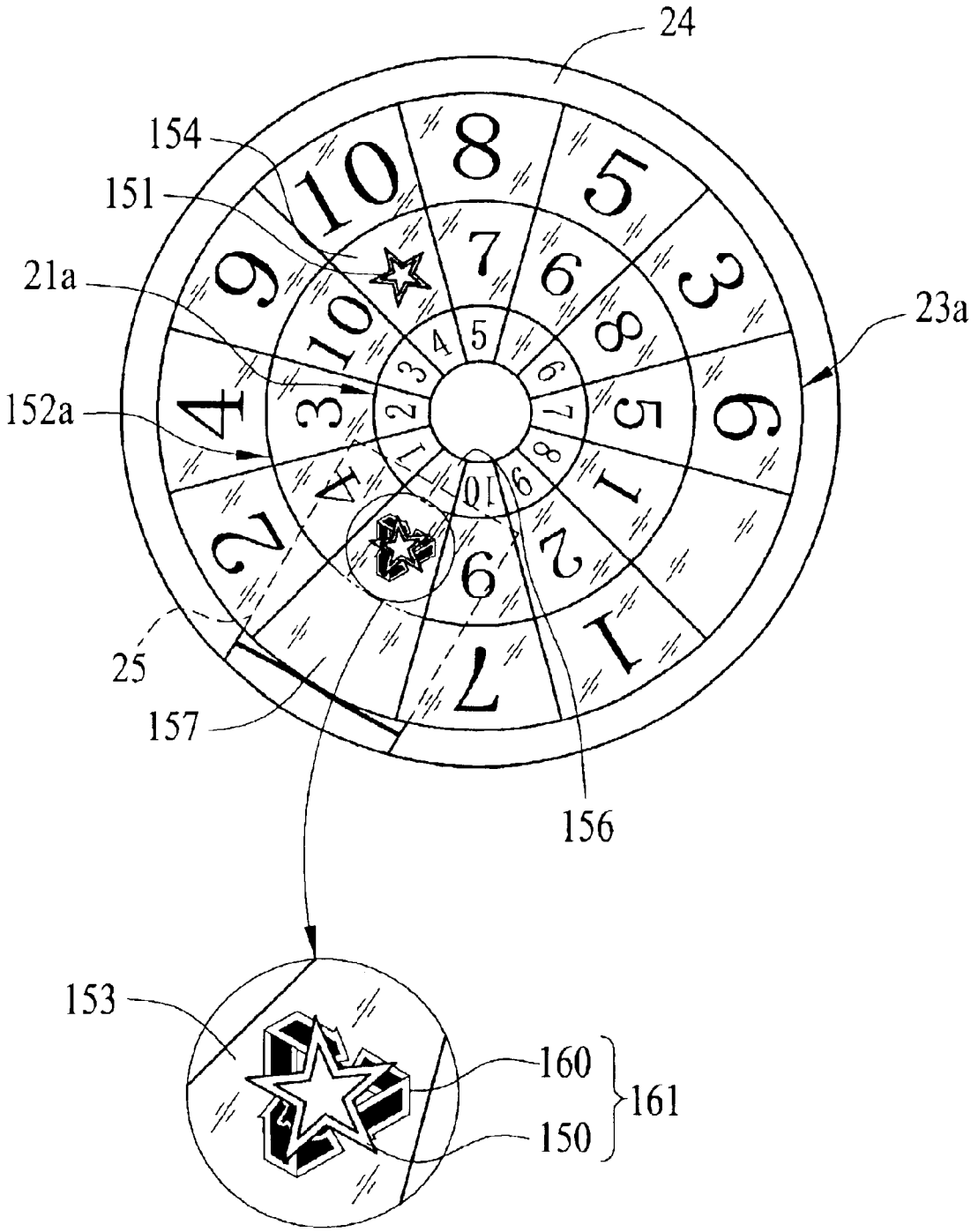
FIG. 20 is a front view illustrating an example wherein the symbols of the sub reel and the second display part compose a composite symbol when the sub reel stops.

For instance, a symbol 160 of the sub reel 25 is displayed behind the star symbol 150, as shown in FIG. 20. In that case, the symbol 160 is overlapped with the star symbol 150 to form a composite symbol 161, so that more dividend coins than other wins are dispensed. It is possible to change the number and the kinds of the composite symbols. In addition, though the star symbols 150 and 151 are provided in transparent parts 153 and 154 in the above embodiment, only the part inside the star symbols 150, 151 may be transparent and the parts outside the star symbols 150, 151 may be opaque. In that case, the symbol of the sub reel is observable through the transparent part inside one of the star symbols 150, 151.

The star symbol 150 is not necessarily stopped on the same line as the blank symbols of the first and third display. It is possible to rotate the sub reel when the star symbol is arranged with other symbols (number symbol, for instance) than the blank symbol. Furthermore, it is also possible to provide three sub reels corresponding to the first to third display parts, and to judge the win or loss based on the symbols on three sub reels.

Figure 21:
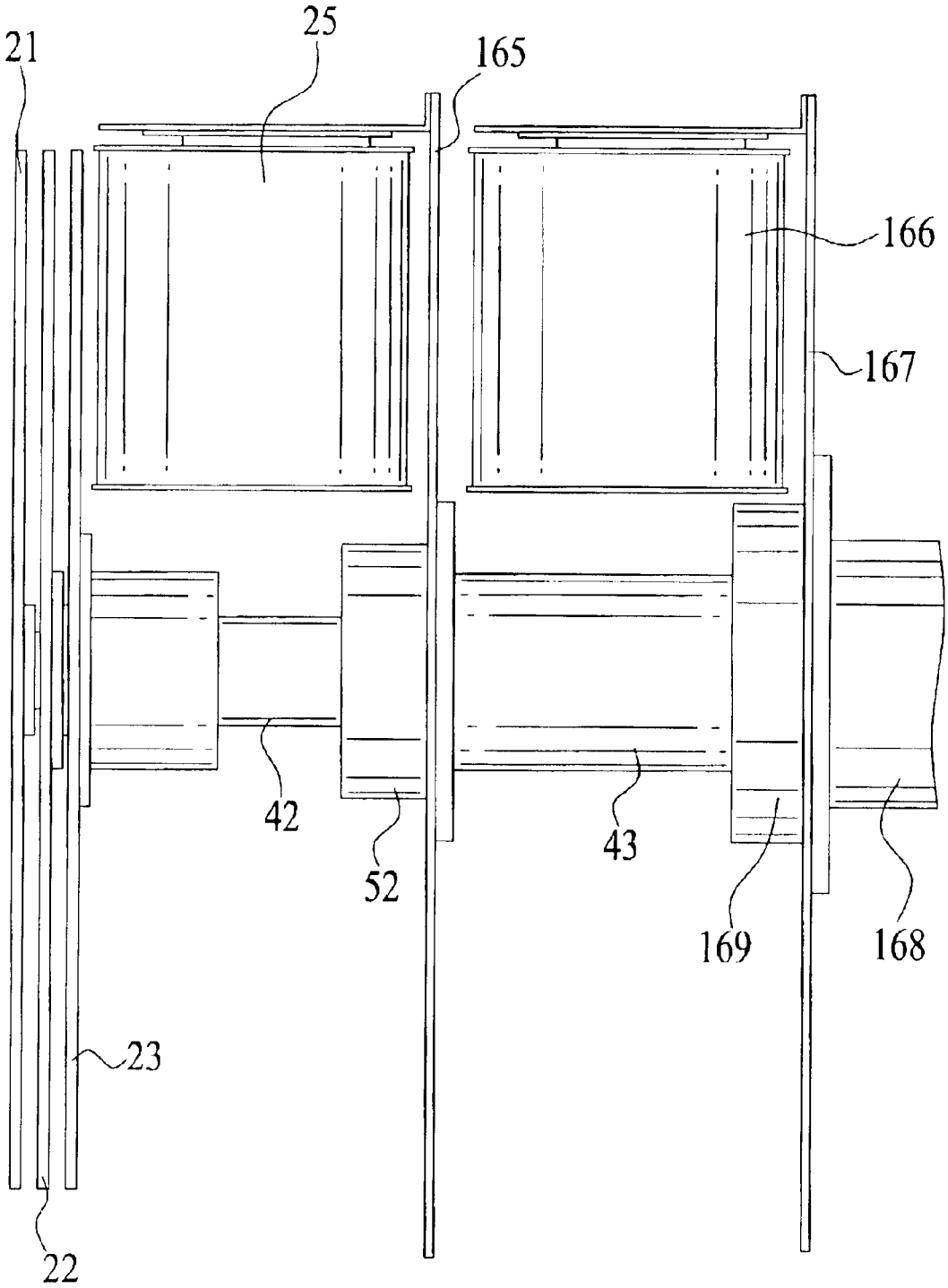
FIG. 21 is a partial cross section illustrating plural reel mounting plates on which the sub reels are mounted.

In the above embodiment, the reel mounting plate (rotator), to which a sub reel (sub display means) is mounted, is disposed behind and concentrically with the first to third. Instead, plural reel mounting plates may be provided. In the following explanation, the same elements as those in the above embodiment are represented by the same reference numerals. As shown in FIG. 21, the sub reel 25 is mounted on a transparent reel mounting plate 165. Behind the reel mounting plate 165, a sub reel 166 is mounted on a reel mounting plate 167. The reel mounting plate 167 is attached to a rotary shaft 168 by a flange 169. The reel mounting plates 165, 167 are concentric with each other. The reel mounting plates 165 and 167 are separately rotatable. Thus, the sub reels 25, 166 may be stopped at different positions to perform various display patterns.

Though the symbol display device is used to execute a sub game after the win in the main game (the slot game) in the above embodiment, the symbol display device of the present invention may be also applicable to a device to determine the amount of dividend coins in the main game or to execute the main game.

Figure 22:
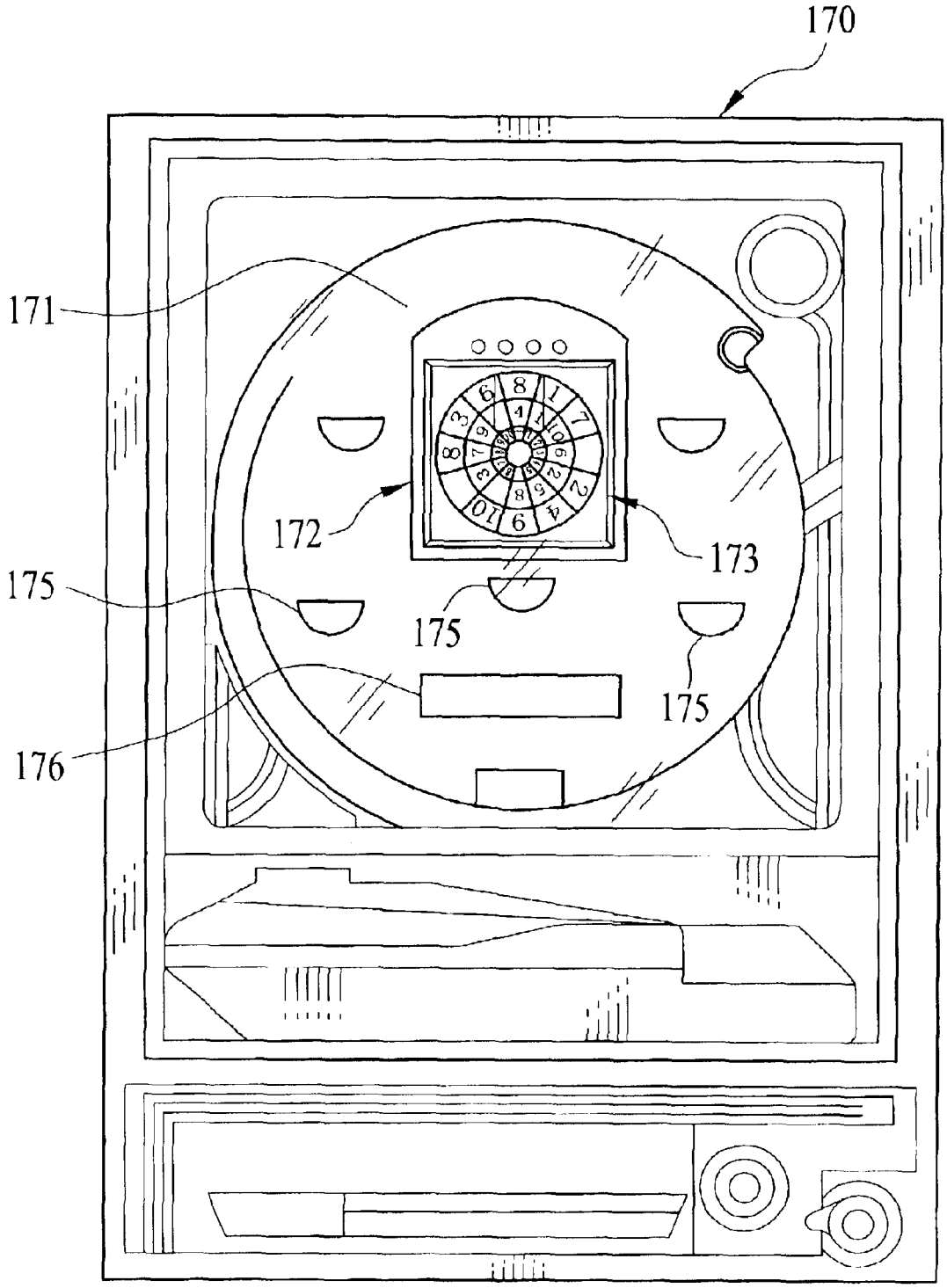
FIG. 22 is a front view illustrating an example of a Pachinko game machine wherein the symbol display device is mounted.

The symbol display device of the present invention may be mounted in the other game machine such as a Pachinko game machine. As shown in FIG. 22, a symbol display device 173 of the present invention is mounted behind a display window 172 formed in the center of a game board 171 in a Pachinko game machine 170. The first to third display plates start rotating under a specific condition such as that, for example, a ball enters a particular hole among winning holes 174 on the game board 171. The player wins a jackpot if the same symbols on the first third display plates are arranged in line. When the blank symbols on the first to third display plates stop in line, the reel mounting plate starts rotating to move the sub reel to behind the blank symbols. Then, the sub reel starts rotating and stops to display the symbol. The player wins a jackpot if the winning symbol of the sub reel is displayed. In the jackpot, an attacker 176 repeats opening and closing a predetermined times, and the player may win a number of premium balls if a boll enters the attacker 176 while it opens. Therefore, the symbol display device of the present invention may give sufficient appeal to the player to win the jackpot, and its various display patterns may enhance the interest of the game.

In the Pachinko game machine, whether the win or the loss is determined by the lottery when a specific condition is completed. In accordance with the result of the lottery, the stop positions for the first to third display plates and the sub reel of the symbol display device are determined. In response to the determination, the symbol display device is operated to rotate the first to third display plates.

In the above embodiments, the symbol display device judges whether the win or the loss in accordance with the combination of the symbols of the first to third display parts and the symbol of the sub reel after the rotation of the first to third display parts and the sub reel. Instead, the symbol display device may determine the win or the loss, and then determine the sop position of the first to third display plates and the sub reel.

Various changes and modifications are possible in the present invention and may be understood to be within the present invention.

What is claimed is:

1. A symbol display device for a game machine, comprising:

plural concentric main display units, each of said main display units having a display part with at least one light-penetrate area in the front side; and a sub display unit, located behind said main display unit, for displaying symbols in motion and/or a static symbol behind at least one of said light-penetrate areas;

a rotary member on which at least said sub display unit is mounted, said rotary member being provided concentrically with said main display unit; and a drive mechanism to rotate plural said main display units and said rotary member separately.

2. A symbol display device according to claim 1, wherein said display part is composed of at least one symbol area in which a symbol is provided and at least one transparent non-symbol area;

wherein said light-penetrate area is said non-symbol area, a transparent area inside said symbol, or a transparent area outside said symbol in said symbol area.

3. A symbol display device according to claim 1, wherein said main display unit has at least one transparent part inside or outside of said display part.

4. A symbol display device according to claim 3, wherein when said sub display unit is stopped in an overlap area where said light-penetrate area of one of said main display units is overlapped with said transparent parts of other main display units, said sub display unit displays symbols in motion and/or a static symbol behind said overlap area.

5. A symbol display device according to claim 1, wherein when said light-penetrate areas of said main display units are stopped and arranged in line, said drive mechanism rotates said rotary member to the position where said sub display unit is overlapped with said light-penetrate areas arranged in line;

wherein said sub display unit displays symbols in motion and/or a static symbol.

6. A symbol display device according to claim 1, wherein said symbol of said sub display unit is overlapped with said symbol of said main display unit so as to form a single composite symbol.

7. A symbol display device according to claim 1, wherein said sub display unit is a mechanical reel.

8. A symbol display device according to claim 1, wherein said sub display unit is a liquid crystal display device.

9. A symbol display device for a game machine, comprising:

plural concentric display plates, each of said display plate having a display part with at least one symbol area and at least one first transparent area:

a sub display unit, located behind said display plates, for displaying symbols in motion and/or a static symbol behind at least one of said first transparent areas;

a rotary plate on which at least said sub display unit is mounted, said rotary plate being provided concentrically with said display plate; and a drive mechanism to rotate plural said display plates and said rotary plate separately.

10. A symbol display device according to claim 9, wherein said display parts of said display plates have ring-shapes with different diameters.

11. A symbol display device according to claim 10, wherein said display plate has a second transparent part inside or outside of said display part.

12. A symbol display device according to claim 11, wherein when said sub display unit is stopped in an overlap area where said first transparent area of one of said display plates is overlapped with said second transparent parts of other display plates, said sub display unit displays symbols in motion and/or a static symbol behind said overlap area.

13. A symbol display device according to claim 10, wherein when said first transparent areas of said display plates are stopped and arranged in line, said drive mechanism rotates said rotary plate to the position where said sub display unit is overlapped with said first transparent areas arranged in line:

wherein said sub display unit displays symbols in motion and/or a static symbol.

14. A symbol display device according to claim 10, wherein said symbol of said sub display unit is overlapped with said symbol of said display plate so as to form a single composite symbol.

* * * * *